United States Patent [19]

Merl

[11] 4,344,367

[45] Aug. 17, 1982

[54] MODULAR PRODUCT DISPLAY SYSTEM

[75] Inventor: Milton J. Merl, New City, N.Y.

[73] Assignee: The Coca-Cola Company, Atlanta, Ga.

[21] Appl. No.: 175,559

[22] Filed: Aug. 5, 1980

[51] Int. Cl.³ ..... A47F 5/12

[52] U.S. Cl. ..... 108/1; 108/8; 108/111; 248/242; 248/250; 211/187

[58] Field of Search ..... 108/8, 1, 109, 111; 248/242, 250; 211/193, 208, 49 D, 134, 187

[56] References Cited

U.S. PATENT DOCUMENTS

| | | | |
|---|---|---|---|
| 1,805,989 | 5/1931 | Levene | 108/1 |
| 2,346,150 | 4/1944 | Brown | 108/1 |
| 2,700,476 | 1/1955 | Maintain | 211/187 X |
| 2,915,196 | 12/1959 | Pim | 108/109 |
| 2,963,170 | 12/1960 | Lori | 108/8 |
| 3,012,678 | 12/1961 | Fiege | 108/109 |
| 3,040,904 | 6/1962 | Amour | 108/1 |
| 3,700,114 | 10/1972 | Myers | 248/242 |

*Primary Examiner*—Francis K. Zugel

*Attorney, Agent, or Firm*—Wolder, Gross & Yavner

[57] ABSTRACT

A modular display system unit for beverage bottles includes a base assembly and at least two spaced apart upright supporting webs detachably connected to the base assembly. A plurality of shelf assemblies are positioned for support between the webs. Each shelf includes a novel top surface sheet to minimize friction forces between the shelf and the bottles to provide a gravity feed capability when the shelves are tilted forward. Brackets are provided for detachable connection to the webs for adjustably supporting the shelf assemblies between the webs at varying heights and angles of inclination with respect to the longitudinal axis of the webs. The webs include an arrangement of keyhole slots, preferably on both sides thereof, but on at least one side, which serve to support the brackets. The arrangement includes a row of central keyhole slots having their axes aligned with each other and parallel to the longitudinal axis of the web. At least one additional row of side keyhole slots having their axes parallel to each other and oriented at an angle of between 5° and 15° with respect to the longitudinal axis of the web is also provided, so that the brackets may be mounted at an angle of inclination with respect to the axis of the web. Each bracket carries upper and lower connector elements for insertion into one of the keyhole slots to support the bracket on the web. Additionally, each bracket has at least one upwardly extending member intended to detachably engage one side of a shelf assembly.

44 Claims, 59 Drawing Figures 124
134
127
137
136
111
129'
138
136
138'
137'
128
134
126
129
133
131
130'
132
140
139
128
213
129
135
130

FIG. 14
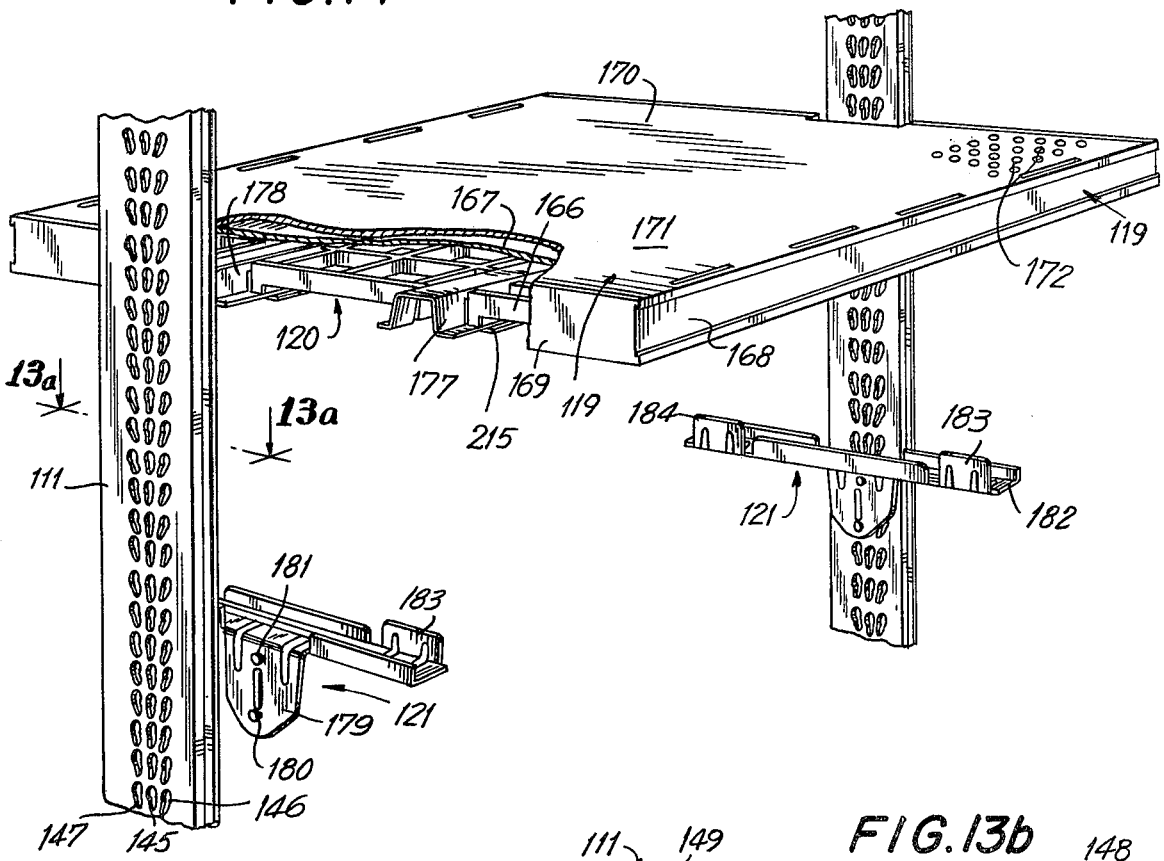
FIG. 14a
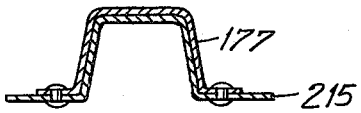
FIG. 13b
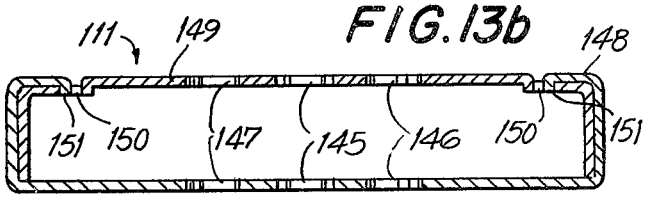
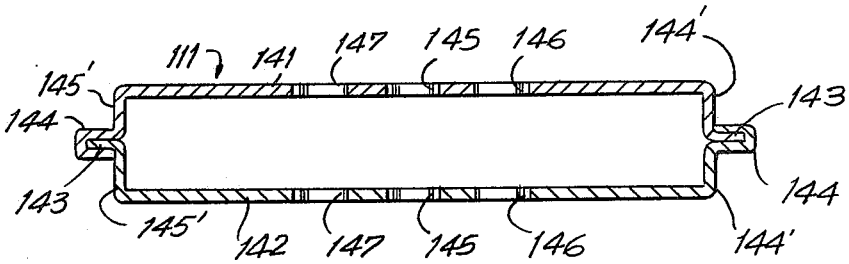
FIG. 13a

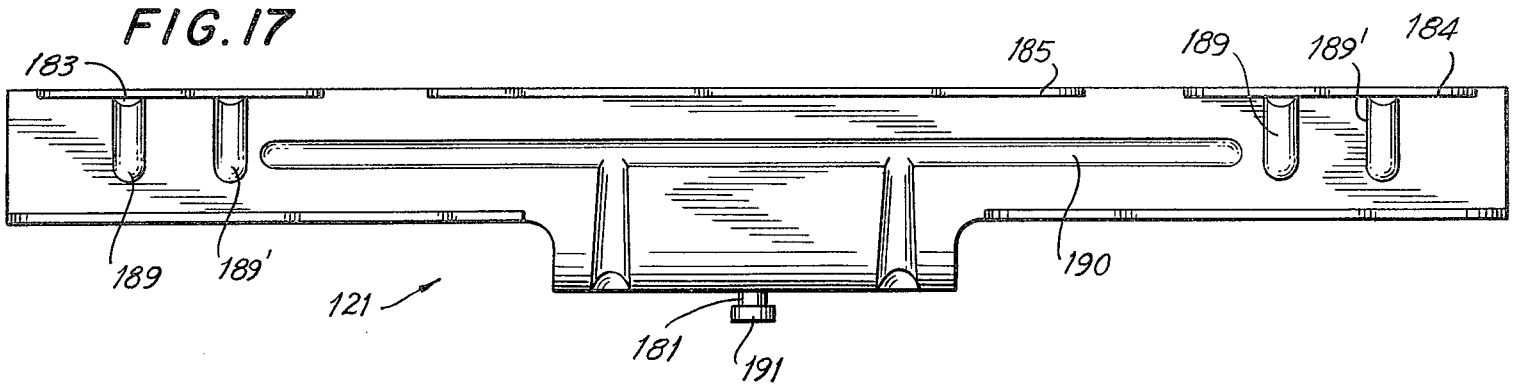
FIG. 17
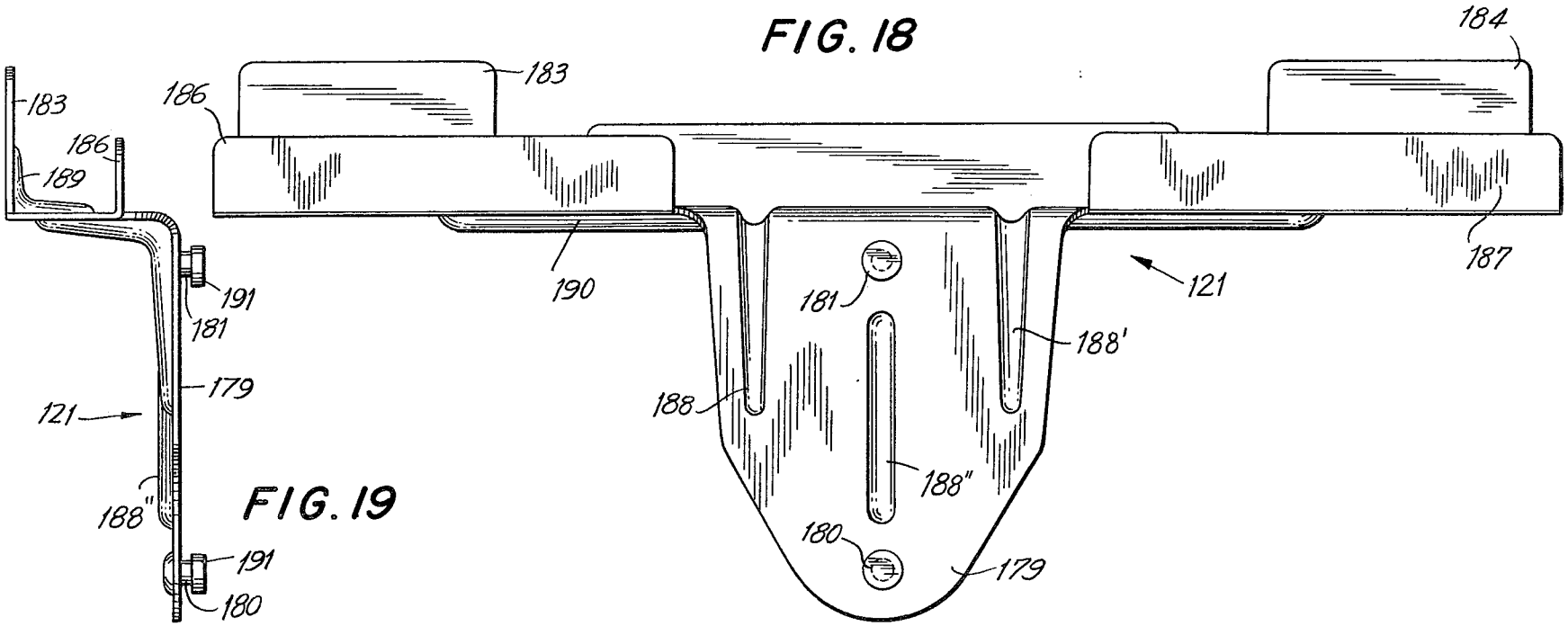
FIG. 18
FIG. 19

198
25
199
188'
25
181
188
200
212

212
197
188'
179
181
188"
180
188
197
211
198
199
198
212
193
200
188
197
211
179
181
191
188"
180
191

FIG. 39
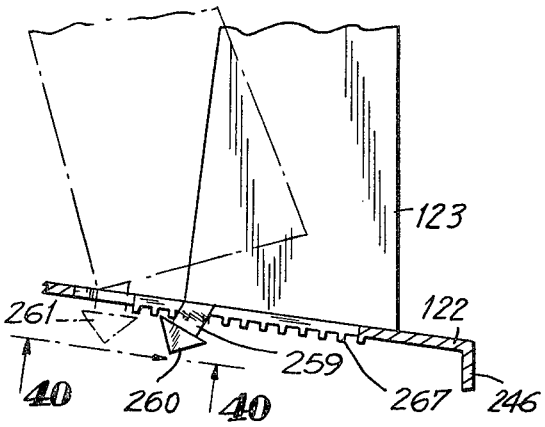
FIG. 40
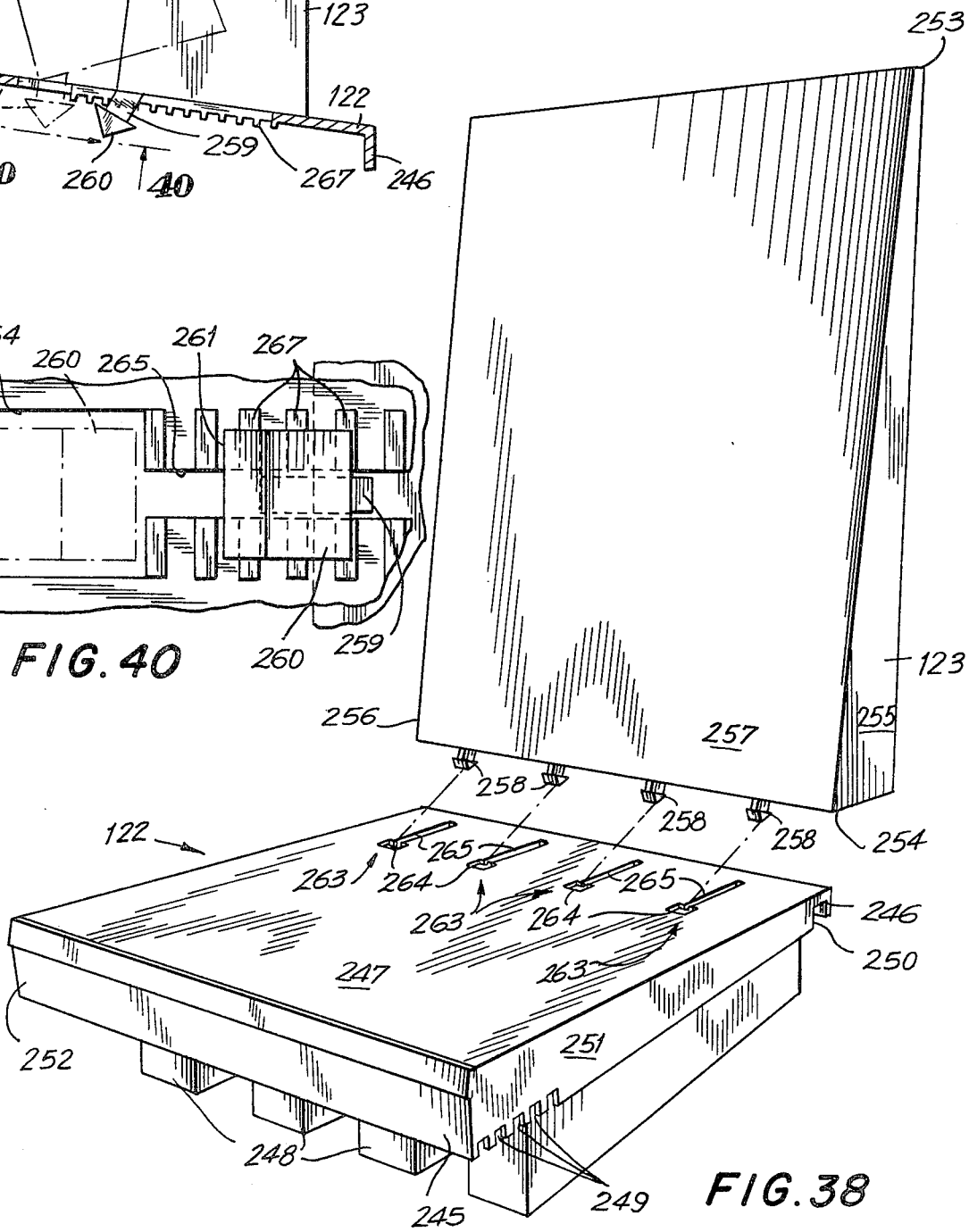
FIG. 38

144
111
291'
291
286
290
290'
285
270
271
273
272
274

MODULAR PRODUCT DISPLAY SYSTEM

BACKGROUND OF THE INVENTION

The present invention relates generally to the field of display devices for exhibiting products to consumers at a point of purchase location, and more particularly, to a novel system for merchandising beverages utilizing a modular concept, for in-store display of beverage products.

A myriad of shelves, racks, carousels and other arrangements, have been used over the years in supermarkets and other point of purchase locations to stock and display beverage products for sale. With particular attention to devices used for storing and displaying beverage bottles, the most commonly found display device consists generally of an array of in-line shelving units, commonly referred to as gondolas. The gondolas include a pair of sidewalls with means for supporting horizontally arranged shelves between the sidewalls. A series of gondolas are placed in alignment to form aisles. As a potential purchaser passes through an aisle, beverage bottles carried on the shelves will be readily visible and available for purchase by the consumer. However, as the bottles are removed from the shelves, the empty spaces at the front of the shelf are not automatically refilled. The automatic gravity feed system of the present invention overcomes this particular disadvantage as will be appreciated hereinafter.

While the well known gondola systems have served the bottling industry well, they tend to lack versatility, adjustability and automatic refilling ability. In other words, once installed in the supermarket, it is difficult, if not impossible, to rearrange shelving or the sidewalls to accomodate new displays in order to enhance merchandising and marketability of the products. Additionally, the currently used shelving systems for displaying beverage bottles in supermarkets are difficult and time consuming to install. Typically, installation of these systems requires the attention of more than a single installer, and usually involves some on-site assembly of parts.

It has also become apparent that the current means for merchandising beverage bottles in the supermarket and grocery store environment have become almost universal, being constructed almost exactly the same in all situations. The result is uniformity in merchandising methods regardless of the brand. Thus, a situation which diminishes a consumer's ability to distinguish between brands has been created. Accordingly, as a result of the same type of beverage display racks being used in most situations, a large number of beverage brands and package sizes, which are currently offered in stores today, have created three principal problems. First, the large number of brands result in confusion since the consumer is unable to readily distinguish between brands. Secondly, is the problem of store maintenance. Third, there are the problems for the individual manufacturers relating to maintaining consumer recognition and national brand impact. Similarities in product packaging and trademark usage tend to additionally confuse the consumer, and the traditional gondola display systems fail to overcome this merchandising difficulty.

The currently available systems also fail to account for varying space limitations depending upon the particular installation. Most of the currently used systems are of standard size and structure, so that variations in rack layout are impossible.

Existing gondola equipment is not readily adaptable to brand identification or brand organization. The result is susceptibility to brand mixing by poor stacking techniques. This results not only in likely confusion to consumers, but produces significant inventory control problems to the retailer. Although Coca-Cola is a highly recognizable brand, consumers inevitably will tend to make mistakes in choice when other cola products, packaged in similar containers, are placed side by side with Coca-Cola products.

Another difficulty with gondola equipment, as currently utilized, is that it cannot handle the inventory required to effectively control out-of-stock situations. This has become a critical situation because of the introduction of the large package sizes, such as the 2 liter bottle. More effective use of available space will likely provide a remedy for this situation. Failure to include any means to automatically refill empty shelf space at the front of the shelves also worsens this situation.

A further shortcoming of the existing gondola systems is the inability to use these systems in a free standing situation. Frequently, a retailer will simply fill available space in a store with open cartons of products. This creates an unattractive and inefficient merchandising situation. It would be far more preferable to locate a free standing merchandising device in the space where open cartons would ordinarily be placed. The shortcomings of the existing systems in the ability to fill empty spaces are overcome by the present invention, as will be appreciated from the discussion hereinbelow.

Case stacking is widely used as the accepted method of mass merchandising goods which are placed on sale below normal retail prices. Old wooden cases, rough cut corrogated cartons and piles of unidentified products are frequently scattered about carelessly, with no preplanning in evidence. The only merchandising technique in these situations is product display cards or handmade signs which are placed on top of or adjacent the stacked cases. For the most part, bottler-supply promotional signs are of poor quality and design, and fail to maintain a brand quality consumer image.

It is, accordingly, one general object of the present invention to provide a new concept in beverage bottle display systems which overcomes the disadvantages of the current and prior art.

More specifically, an object of the present invention is to provide a beverage display system utilizing a modular concept for in-store display of beverage products, which is simple to erect and install, and which is readily movable for rearrangement to accomodate new displays and enhance merchandising beverage products.

Yet another specific object of the present invention is to provide a system for merchandising beverage bottles which gives maxium product display and accessibility, while simultaneously, maintaining the integrity of the brand being displayed and merchandised.

A still further object of the present invention is to provide a beverage bottle display and storage system which as a shelf assembly with an automatic gravity feed capability so that as bottles are removed from the front, the empty spaces will automatically be refilled by bottles from the rear.

Another object of the present invention is to provide a device which forms a modular part of a merchandising system, which is capable of taking advantage of space limitations and can be utilized either in a free standing situation or an in-line arrangement.

Yet a further specific object of the present invention is to provide a system of merchandising beverage bottles which includes structural web elements or uprights for supporting therebetween, a variety of shelving assemblies in an almost infinite number of arrangements.

Additionally, the present invention is intended to provide means and capability for distinct product identification, while simultaneously, providing structural integrity to the unit.

Other objects, advantages and features of the present invention will become readily apparent, to those skilled in the art, from the detailed description of the invention in connection with the annexed drawings to be described more fully hereinafter.

SUMMARY OF THE INVENTION

The foregoing objects, features and advantages of the present invention are generally accomplished by providing a modular product display unit including a base assembly and at least two spaced apart upright supporting webs detachably connected to the base assembly. A plurality of shelf assemblies are positioned for support between the webs. Each shelf assembly includes a novel top surface sheet to minimize friction forces between the shelf and the bottles to provide a gravity feed capability when the shelves are tilted forward. Bracket means are provided for detachable connection to the webs for adjustably supporting the shelf assemblies between the webs at varying heights and angles of inclination with respect to the longitudinal axis of the webs. The bracket means are provided with means for detachably engaging the shelf assemblies. The webs include an arrangement of keyhole slots, preferably on both sides thereof, but on at least one side, which serve as means for supporting the brackets. The arrangement includes a row of central keyhole slots having their axes aligned with each other and parallel to the longitudinal axis of the webs. At least one additional row of side keyhole slots having their axes parallel to each other and oriented at angle of between 5° and 15° with respect to the longitudinal axis of the web is also provided, so that the brackets may be mounted at an angle of inclination with respect to the axis of the web in order to provide the gravity feed capability. Each bracket carriers upper and lower connector elements for insertion into one of the keyhole slots to support the bracket on the web. Additionally, each bracket has at least one upwardly extending tab member intended to detachably engage one side of a shelf assembly.

The foregoing concept is erector set in nature, capable of applying common junction techniques so as to enable continuous add-on building capacity limited only by the dimensions of the store. The present invention may be provided in any size and is capable of operating in free standing or in-line situations.

BRIEF DESCRIPTION OF THE DRAWINGS

In the drawings:

FIG. 3(*b*) shows a detail of one element illustrated in FIG. 3(*a*);

FIG. 3(*c*) is an exploded perspective view, similar to FIG. 3(*a*), illustrating another embodiment of a header assembly of the present invention;

FIG. 13(*a*) is a sectional view taken along lines 13(*a*-)—13(*a*) of FIG. 14, illustrating one embodiment of the web;

FIG. 13(*b*) is a sectional view, similar to that of FIG. 13(*a*), illustrating another embodiment of a web;

FIG. 14 is a perspective exploded view with part of the shelf illustrated therein broken away;

FIG. 14(*a*) is a sectional view taken along lines 14(*a*-)—14(*a*) of FIG. 14;

FIG. 17 is a top view of the embodiment of a bracket used for supporting a shelf assembly on the web system as shown in FIG. 16;

FIG. 18 is a front elevational view of the bracket illustrated in FIG. 17;

FIG. 19 is a side elevational view of the bracket illustrated in FIGS. 17 and 18;

FIG. 38 is an enlarged perspective view illustrating a further feature of the present invention relating to a bottom and back wedge arrangement;

FIG. 39 is a schematic representation indicating the mechanism for supporting the back wedge on the bottom wedge of the arrangement shown in FIG. 38, and the means by which such positions can be adjusted;

FIG. 40 is a bottom view taken in the direction of lines 40—40 of FIG. 39;

DESCRIPTION OF THE INVENTION

Figure 1:
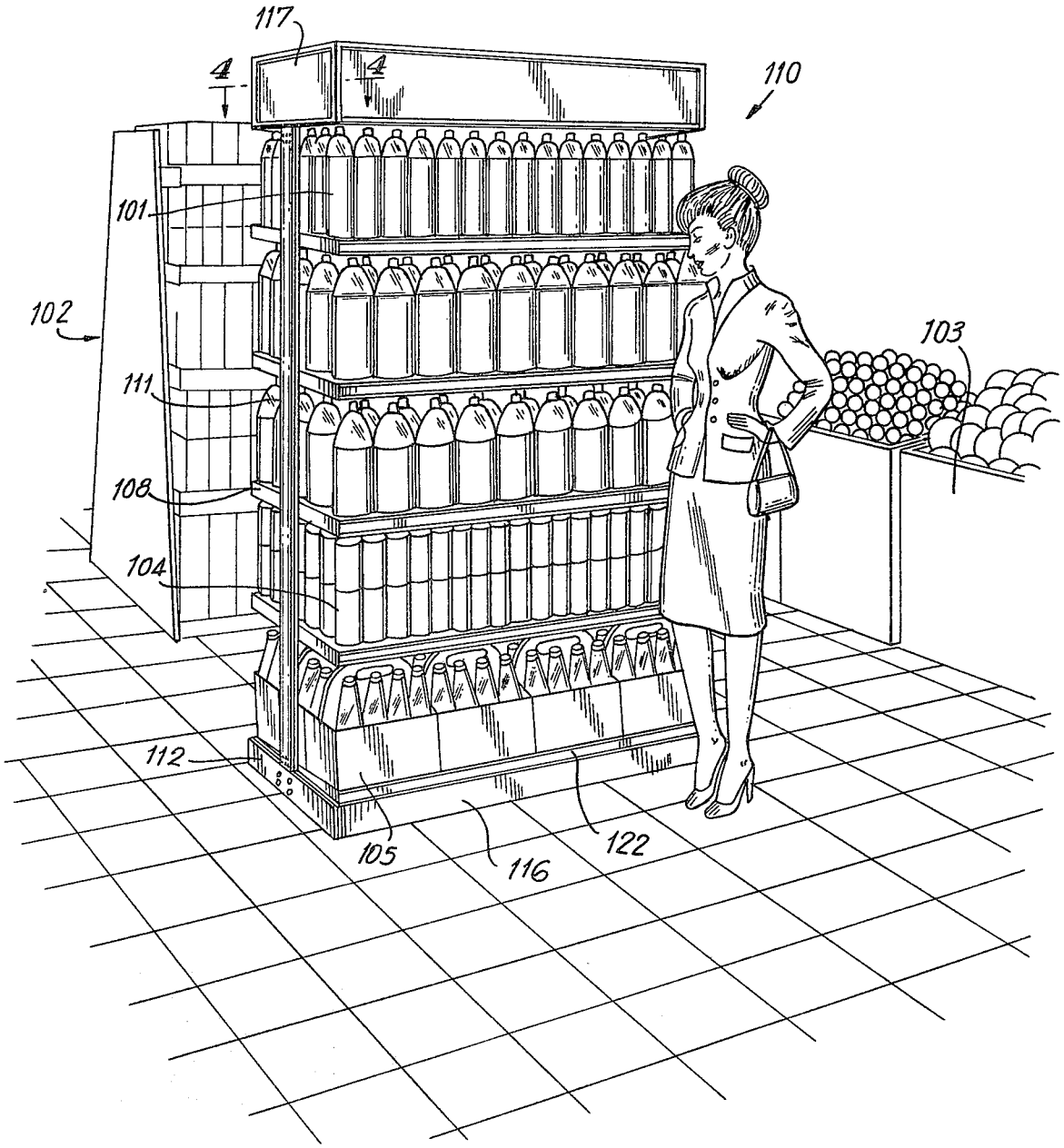
FIG. 1 is a perspective view illustrating the modular product display system of the present invention in a point of purchase free standing arrangement carrying beverage products for display and marketing.

Referring now in more detail to the accompanying drawings, FIG. 1 shows the modular product display system of the present invention, referred to generally as reference number 110, in a free standing situation, surrounded by other typical display devices 102 and 103 currently in use. The display system of the present invention is shown for accomodating beverage bottles 101, beverage cans 104 and beverage bottles contained in prepacked units 105.

As noted hereinabove, the system of the present invention is of the web type, the details of which will be more fully appreciated in connection with the exploded perspective view of FIG. 2 and various details shown in other figures.

Figure 50:
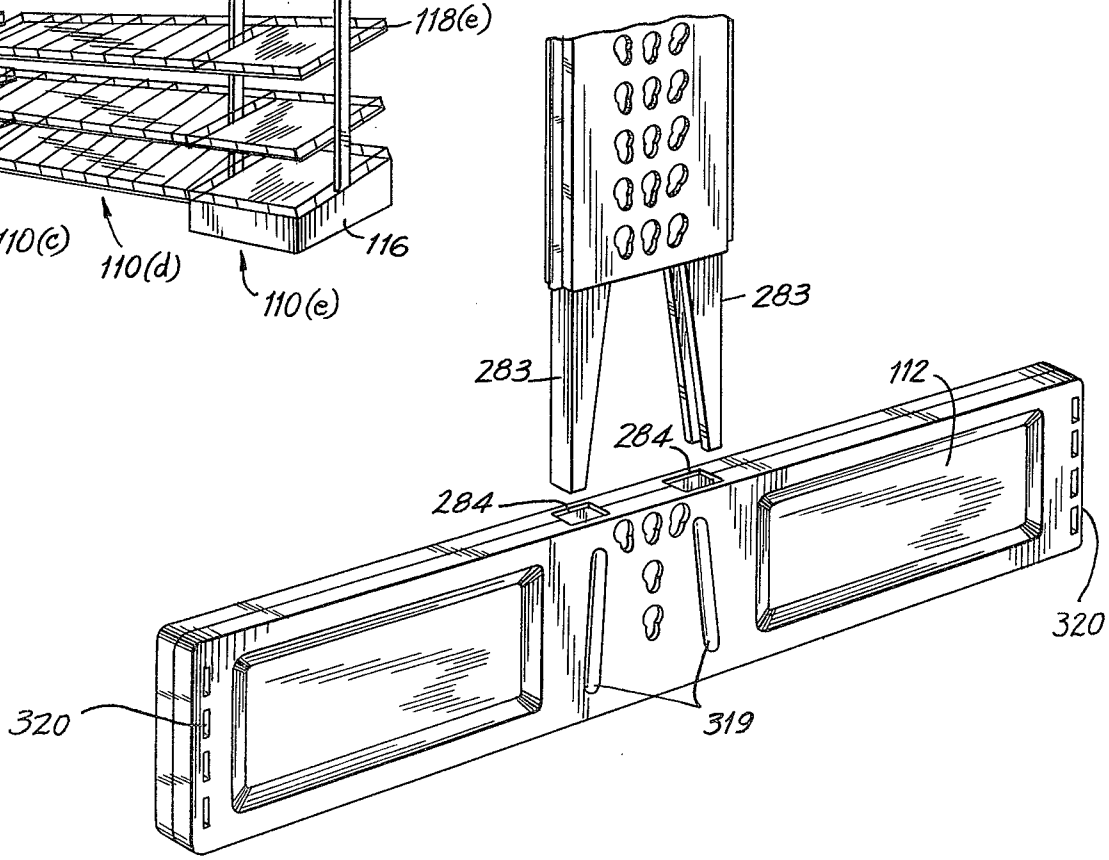
FIG. 50 is an enlarged and exploded perspective view showing another embodiment of the coupling between a web member and a foot member.
Figure 51:
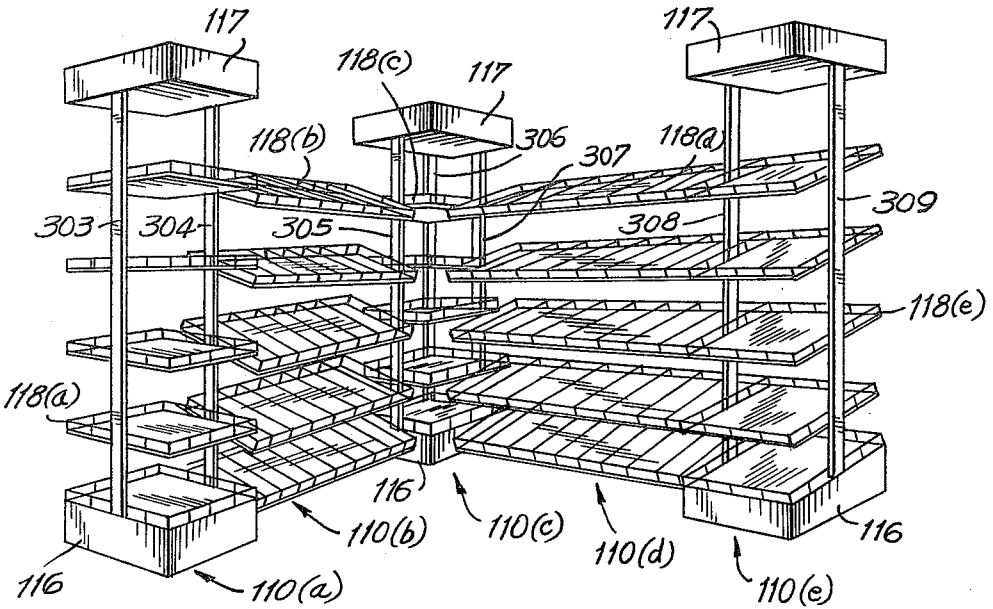
FIG. 51 is a schematic representation illustrating one example of an arrangement using the web system of the present invention.
Figure 52A:
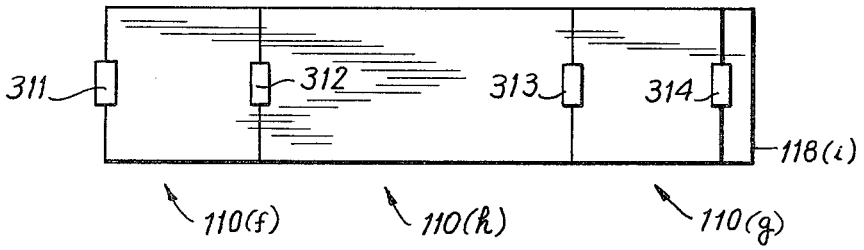
FIGS. 52(*a*) and 52(*b*) are plan and elevational views, respectively, illustrating a typical in-line standing arrangement of the present invention.
Figure 52B:
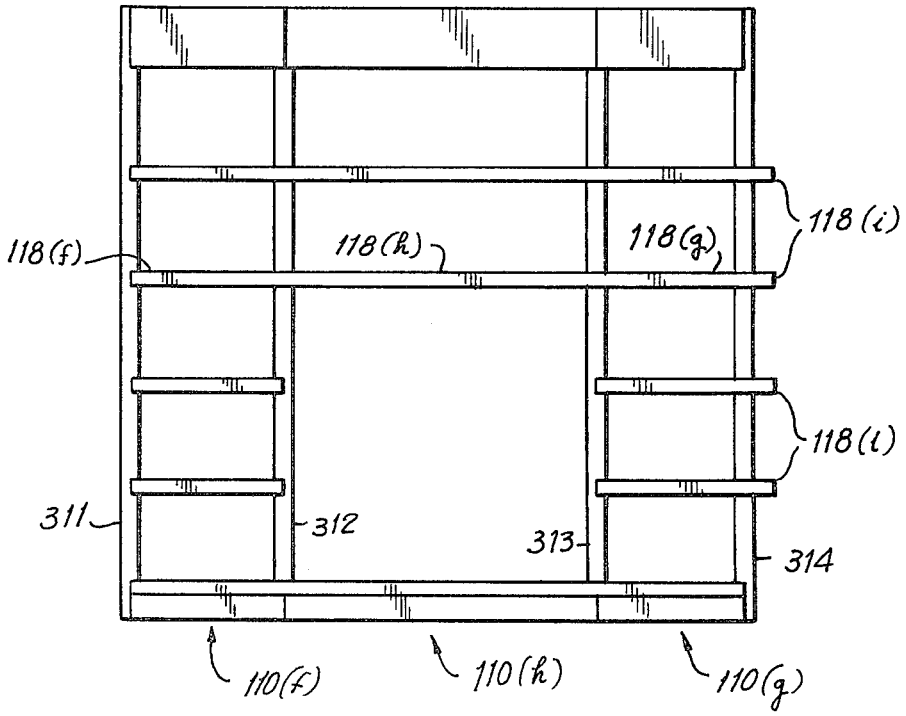
Figure 53A:
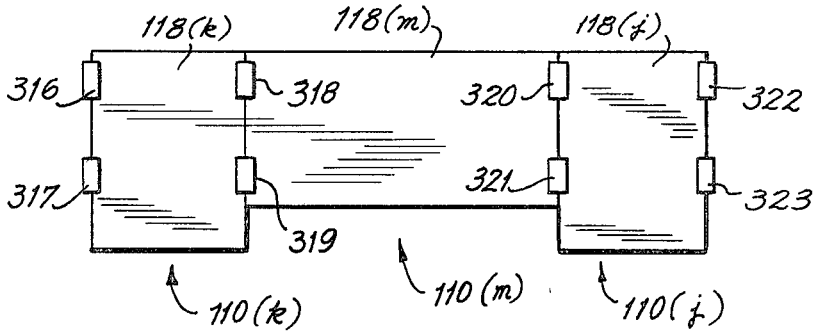
FIGS. 53(*a*) and 53(*b*) are plan and elevational views, respectively, illustrating yet another free standing or in-line arrangement utilizing the present invention.
Figure 53B:
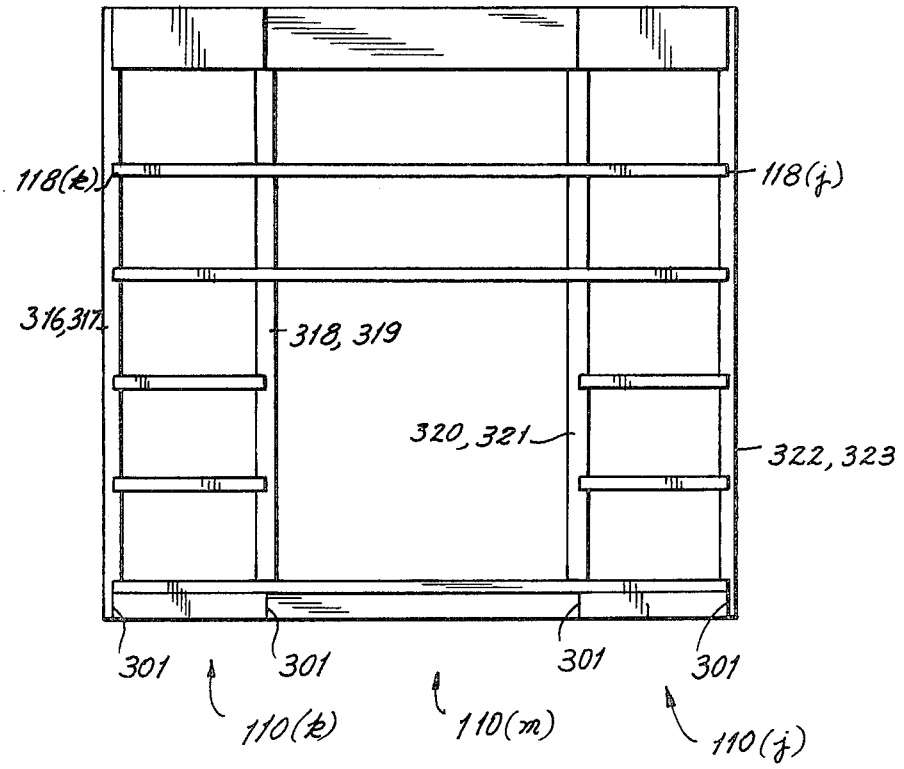

Specifically, the concept of a modular unit which can be used either in a free standing situation, such as illustrated in FIG. 1, or in a more conventional in-line situation, such as illustrated in FIGS. 51 through 53, to be described more fully hereinafter, is accomplished by providing a pair of spaced apart uprights or web elements 111, each of identical construction, and supported by a base assembly 116. The system is designed to support shelf assemblies between either a pair of webs or uprights on each side, or between only two webs, i.e., only one web on each side. One of the key features of the present invention is ease of assembly and erection at the store site. This is accomplished by using an erector set concept. Accordingly, the base assembly 116 includes a foot 112 provided to support each web in an inverted "T" configuration. Because it is one of the objects of the invention to provide a system which is adaptable to various space requirements, the length (i.e. distance between webs), and depth (i.e. front to back) dimensions of the shelf assemblies 118, which are to be positioned between the webs, can be varied. Accordingly, each foot member 112 can similarly be provided in a variety of sizes corresponding to the depth of the shelves. It would, therefore, be impractical to provide a one piece web and foot arrangement since this would require maintaining a large inventory of "T" configured elements. Therefore, each web 111 is designed to be removably connected with each foot 112 in a manner to be described in detail in connection with FIGS. 45 through 50.

The feet 112, on opposite sides of the unit 110, are joined by a front kick plate 114 and a rear kick plate 115. The kick plates provide structural integrity to the unite, and together with the feet form the base assembly 116 of the system.

A header assembly, referred to generally as reference number 117, is used to provide further structural support and rigidity between the webs 111. Promotional copy is also intended to be carried by the header assembly. Details of the header assembly will be described more fully hereinbelow in connection with FIGS. 3 through 5.

Figure 15:
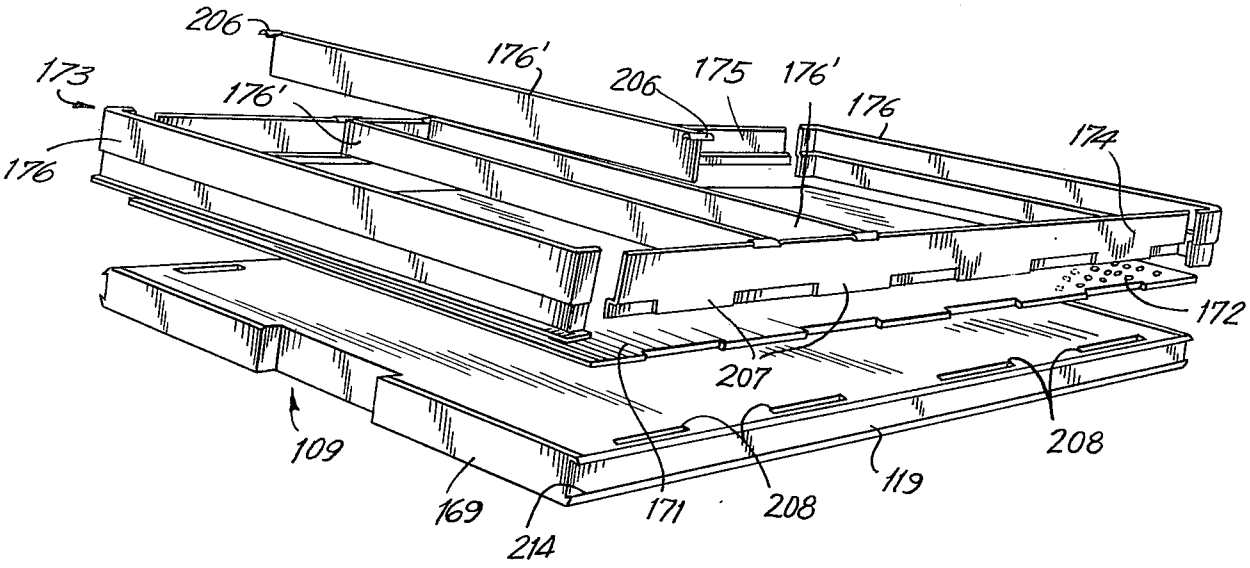
FIG. 15 is an exploded perspective view of a shelf assembly used in the present invention

A plurality of shelf assemblies 118 are adjustably supported between the webs 111. The shelf assemblies can be made of a variety of materials, however, it has been found that a plastic material provides ease of manufacture with sufficient strength. A light weight construction is most desirable. FIGS. 2, 14 and 15 illustrate the shelf construction. The shelf assembly 118 is formed principally of a shelf unit 119, which is molded of polyester, polyethylene or polypropolene. When the shelf units 119 are supported between the webs, the unit 110 is more stable and avoids anti-racking (swaying). The more shelves supported between the webs 111, the more stable the unit is likely to be.

Figure 2:
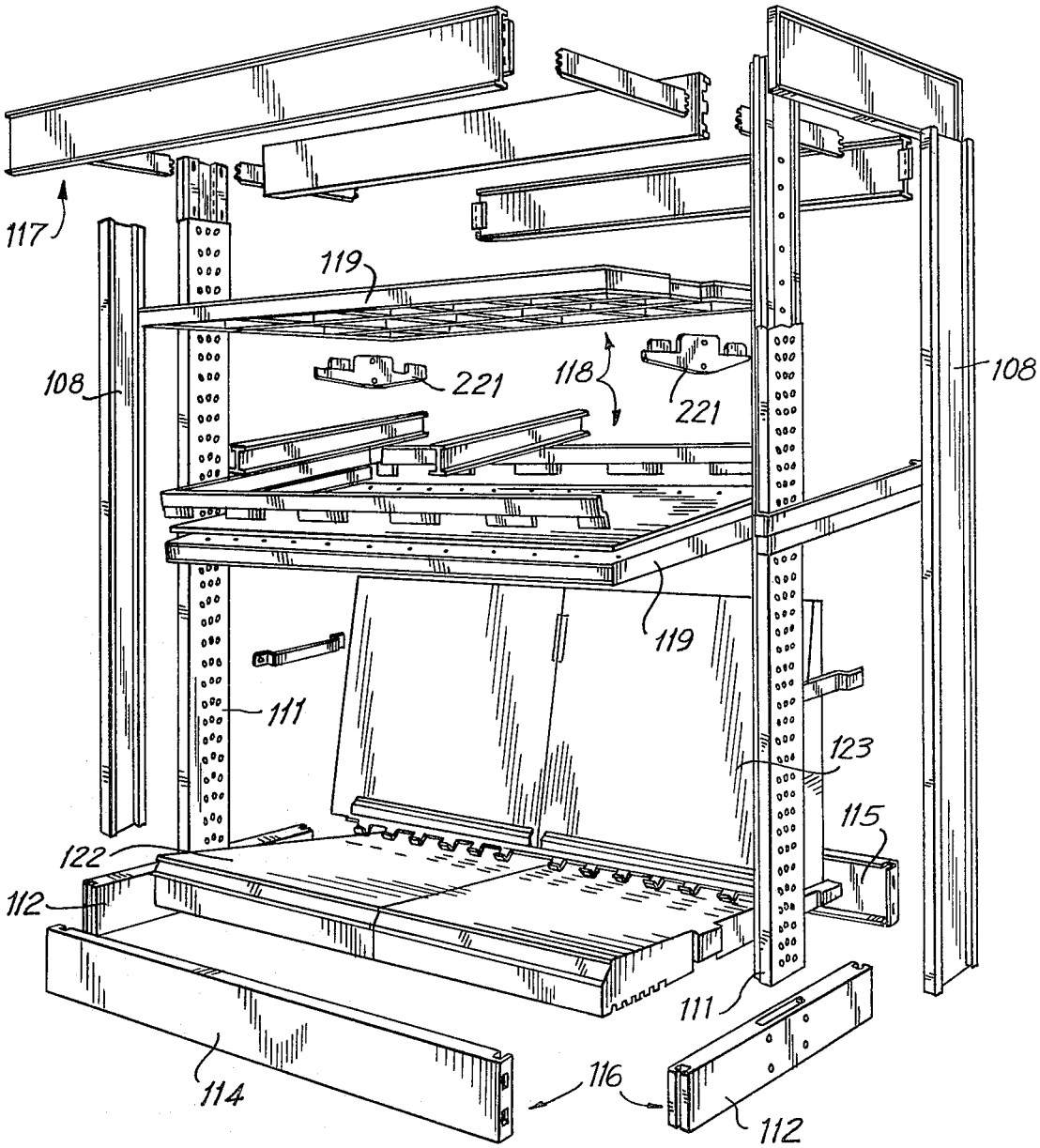
FIG. 2 is an exploded perspective view of the system of the present invention.

The shelves 119 are supported for height adjustment between the webs by brackets 221, only one form of which is illustrated in FIG. 2. Other embodiments of the brackets will be described in detail hereinbelow in connection with FIGS. 16 through 37.

In addition to the foregoing basic subassemblies, a bottom wedged shaped shelf 112 can be provided within the base 116. A back wedge 123 is preferably provided to support items which are stacked on the bottom wedge shelf. Accordingly, items stacked on the bottom wedge arrangement can be slightly tilted to the rear and supported by the back wedge 123. The wedge arrangement is described more fully in connection with FIGS. 38 through 44.

Header Assembly

Figures 3A, 3B, 3C:
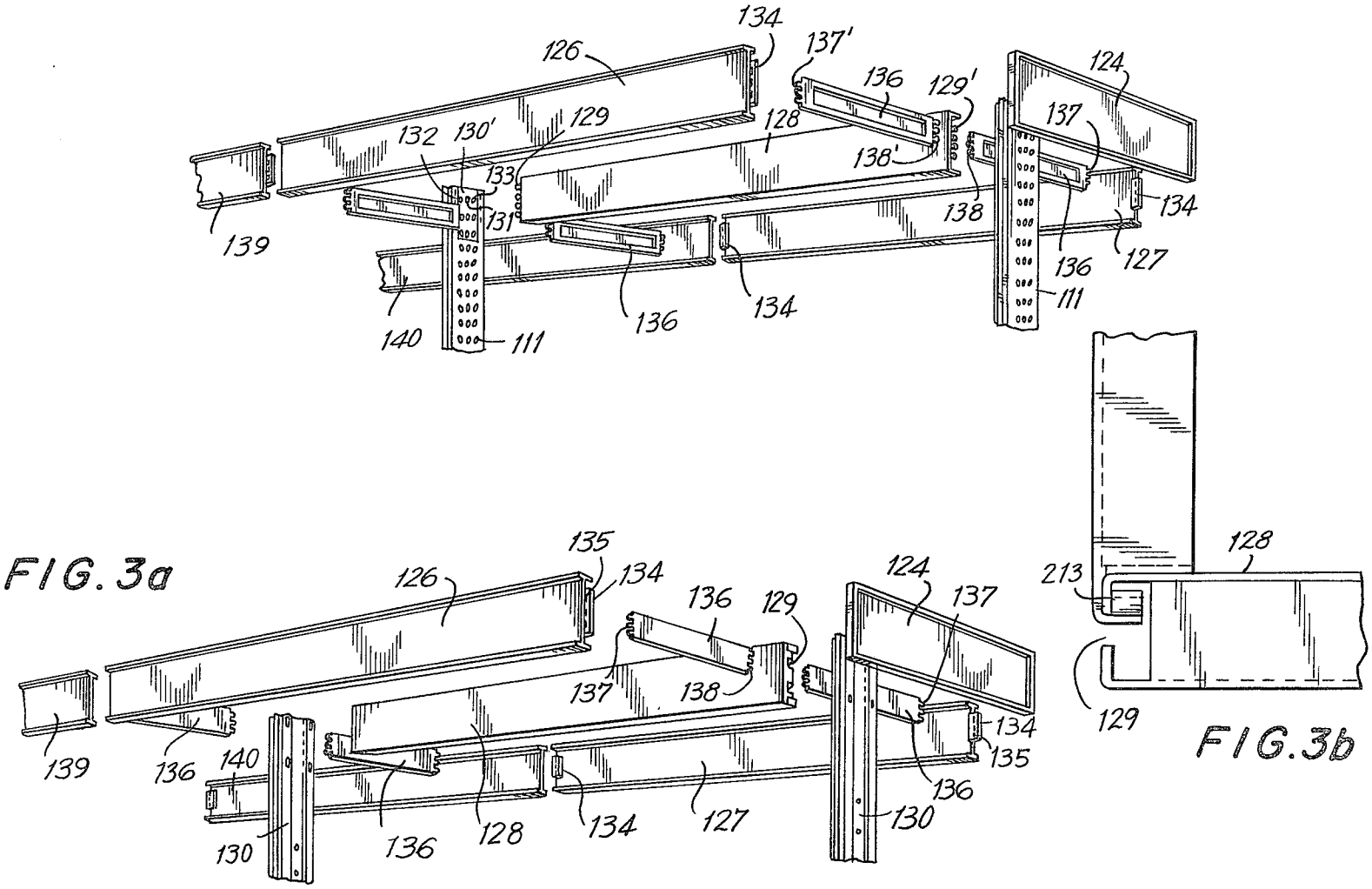
FIG. 3(*a*) is an exploded perspective view illustrating one embodiment of header assembly of the present invention.
Figure 4:
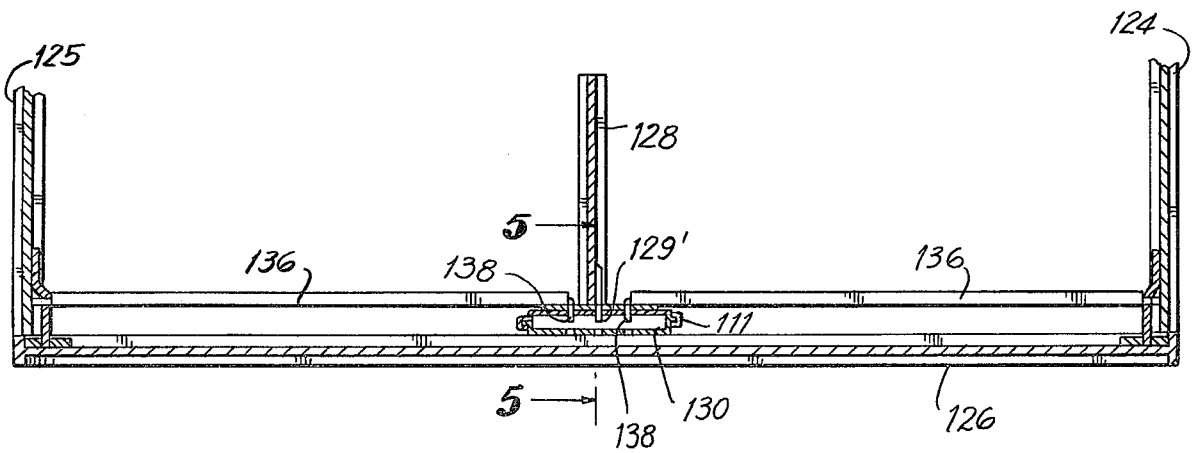
FIG. 4 is a cross sectional view taken along lines 4—4 of FIG. 1, further illustrating the embodiment of FIG. 3(*c*)
Figure 6:
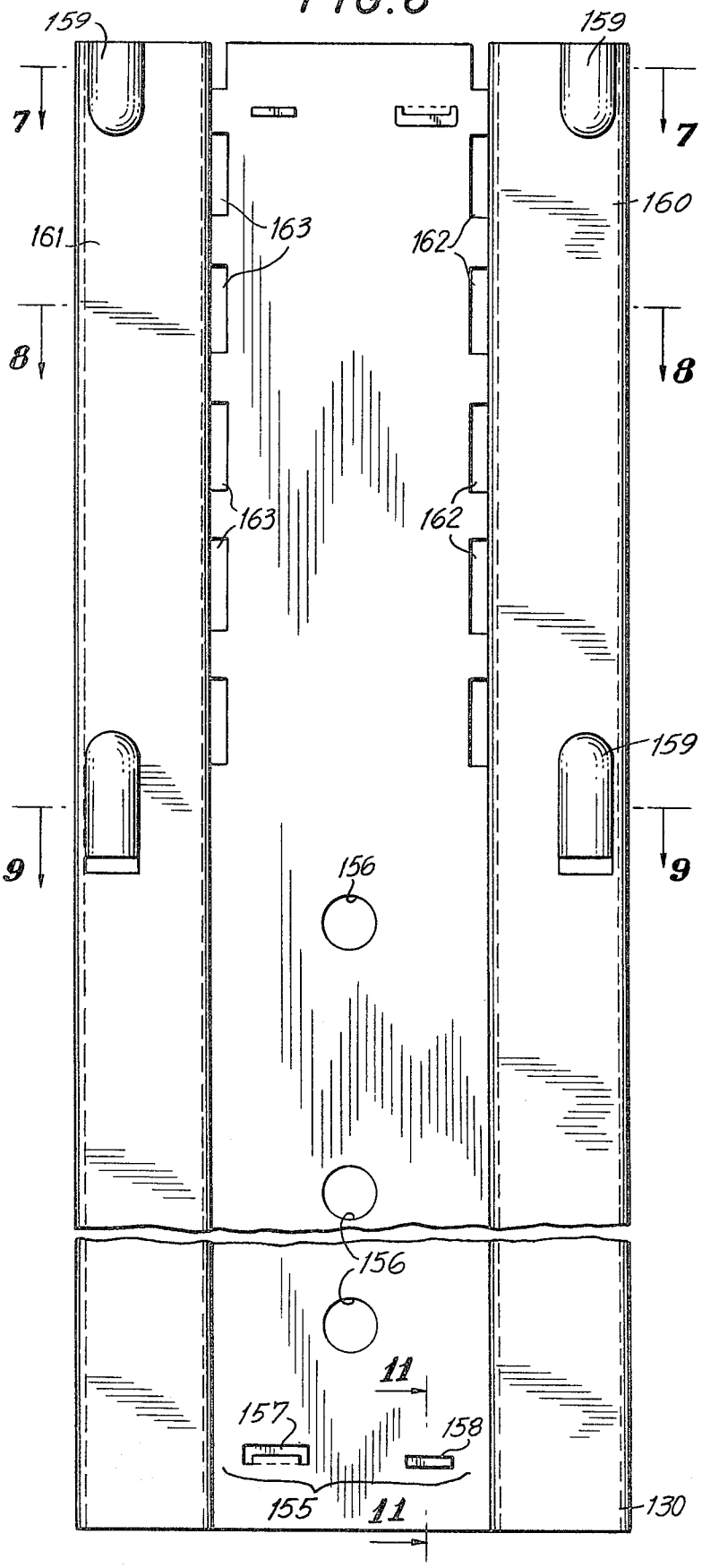
FIG. 6 is a side elevational view of a web extension for use with the present invention.
Figure 10:
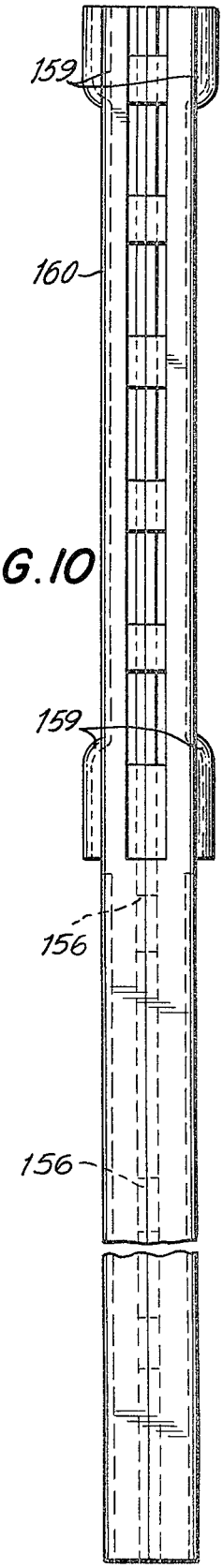
FIG. 10 is an edge elevational view of the web extension, shown in FIG. 6.
Figure 7:
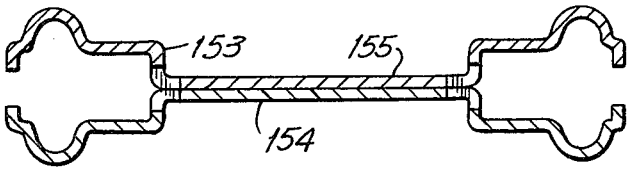
FIG. 7 is a sectional view taken alongs lines 7—7 of FIG. 6.
Figure 8:
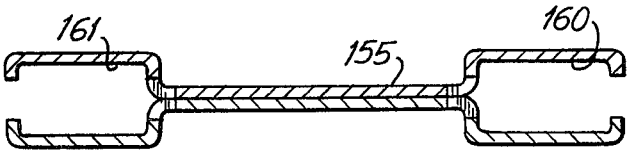
FIG. 8 is a sectional view taken along lines 8—8 of FIG. 6.
Figure 11:
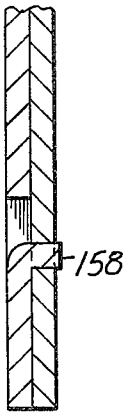
FIG. 11 is a sectional view taken along lines 11—11 of FIG. 6.
Figure 9:
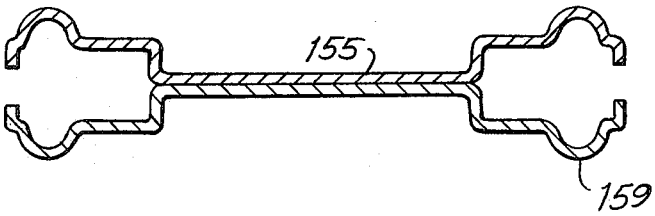
FIG. 9 is a sectional view taken along lines 9—9 of FIG. 6.

Turning now to the header assembly 117, FIG. 3(*a*) illustrates the details of a preferred structure. The assembly is supported by a web extension 130, which is described in greater detail with reference to FIGS. 6 through 11. Extension 130 fits into and is supported at the top end of a web 111, as will be described further hereinbelow in connection with FIG. 12. The header assembly includes side display panels 124 and 125, and front and rear display panels 126 and 127, respectively. A center beam 128 has ends 129, shown in detail in FIG. 3(*b*), with "L" shaped bent over edges 213 which engage vertical slots provided on the web extension 130. The center beam 128 thereby provides top support and connection between the webs 111.

Each of the front and rear display panels 126 and 127 are provided with end tabs 134, which carry a series of slots 135. Support beams 136 are each provided at one end thereof with a first set of tab fingers 137 intended to engage the slots 135, and a second set of tab fingers 138 at the other end thereof which are arranged at a 90° angle with respect to the plane of the support beams 136 for engaging a set of slots 162 or 163 on the web extension 130 (see FIG. 6). In this manner, the front and rear display panels are securely mounted to the web elements 111. Each of the side panels 124 and 125 are similarly provided with slots at opposite ends thereof (seen in FIGS. 4 and 5), so as to be supported by tab fingers carried by the front display panels.

In situations where the system of the present invention is used in the in-line configuration, front and rear display panels 139 and 140, of the adjacent modular unit, would be connected to the front and rear panels 126 and 127, respectively, by means of support beams 136 and fingers 137. In this situation, no side display panel 125 would be provided.

Figure 5:
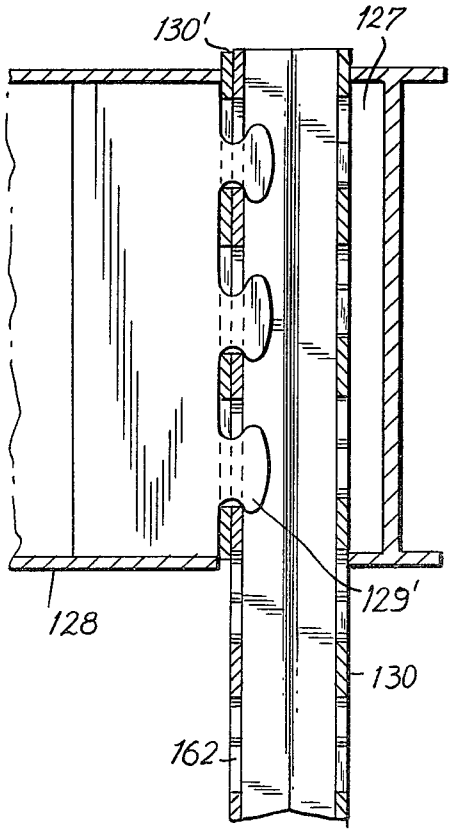
FIG. 5 is a sectional view taken along lines 5—5 of FIG. 4.

FIGS. 3(*c*), 4 and 5 illustrate an alternative construction for the header assembly. The basic elements of the assembly are as described in connection with FIG. 3(*a*), and accordingly, like parts are denoted by like reference numerals. In the embodiment of FIG. 3(*c*), the web extension 130' carries a series of keyhole slots, specifically a center keyhole slot 131, and side keyhole slots 132 and 133. The center beams 128 has downwardly extending hook fingers 129' which engage the center keyhole slot 131 of the web extension 130'. Fingers 137' and 138', carried by the support beams 136, are also shaped as illustrated in FIG. 5 to engage the slots 134 on the front and rear display panels, or the keyhole slots 132 and 133 on the web extension 130'. In other details, the header assembly of FIGS. 3(*c*) through 5 is similar to that illustrated in FIG. 3(*a*).

The center beam 128 is of identical construction to the kick plates 114 and 115 to minimize the numbers of parts used. Accordingly, the ends 129 of the kick plates (as illustrated in FIG. 3(*b*)) engage the ends of feet 112 to form the base assembly 116.

It should be noted that in addition to providing structural rigidity to the modular unit of the present invention, the header assembly is used for displaying advertising material on the front, rear and side panels.

The Web and Web Extension

Each web is intended to support shelves mounted on opposite sides thereof, so that each web serves as a common support member for adjacent modular units. When the webs support a free standing unit, as shown in FIG. 2, or for those webs provided at the end of an in-line arrangement, web covers 108 are used to cover keyhole slots (described below) and to provide additional space for advertising copy. Accordingly, the webs are preferably formed as a duct-work channel member, such as illustrated in FIGS. 13(*a*) and 14, having a first profile 141 and a second profile 142. Each profile is identically formed with an extension element 143 at one end thereof, and a "C" shaped section 144 at the other end thereof. The "C" shaped sections 144 are crimped about the extensions 143 to form a rigid duct-work assembly. Shoulders 144' are thus formed at one end of the assembly and shoulders 145' are formed at the other end of the assembly. Each profile 141 and 142 is punched with a series of identical keyhole slots. The slots are arranged in three columns, consisting of a column of center keyhole slots 145 and columns of side keyhole slots 146 and 147. Additionally, the slots are provided in rows extending from top to bottom to provide height adjustability for the shelves.

An alternate form of web construction is illustrated in FIG. 13(*b*). In this variation, the web 111 is similarly duct shaped, and is formed of a first profile 148, which is "C" shaped in configuration and a second profile 149, similarly shaped in configuration. Profile 149 is, however, provided with a slot 150, and profile 148 is provided with a finger 151 intended to engage the slot 150. Accordingly, profiles 148 and 149 fit together, so that open ends of each "C" section face each other. The center and side keyhole slots are provided in a manner similar to that shown in the web construction illustrated in FIG. 7.

While other structural arrangements for the web might be found to be equally satisfactory, the construction illustrated in FIG. 13(*a*) has been found to simplify manufacturing procedures and be of sufficient strength to support the shelves. It is believed to be of significance that the joint between the first and second profiles be such as to prevent the profiles from collapsing together or sliding one with respect to the other. This would eliminate any lateral or tortional instability that the webs would have.

The web member 111 will typically be constructed and stored in a variety of standard sizes. However, the web extensions will serve to eliminate some height problems. The web extension, shown in FIGS. 6 through 12, is designed to be inserted into the top of an open web element to provide an adjustment of between 10 and 15 additional inches of height. Further, the web extension is intended to support only the header assembly 117. In its preferred form, it is not provided with a series of keyhole slots, which would be suitable for supporting the shelves by the brackets.

The web extension 130 is formed of two identical profiles 153 and 154. The profiles are welded together along a central section 155 running the full height of the extension. A series of holes 156 are provided through the central section at various heights to provide a means for securing the web extension to the web member 111 through a center keyhole slot 145. Guide slots 157 and 158 serve to secure the web extension 130 in the web elements 111.

Stop elements 159 are formed in the profiles 153 and 154 to limit the extent of insertion of the web extensions into the web elements.

The sides of the web extension are formed by channels 160 and 161, designed to fit with a tight tolerance into the duct-work formation of the webs 111.

When inserted into the top of the webs 111, holes 156 will be brought into alignment with center keyhole slots 145 on the webs 111. A pin or other fastening mechanism will be inserted through the center keyhole slots on one side of the web element, through the hole 156 and through the keyhole slot on the other side of the web element, to thus secure the web extension in the web element.

The web extension is provided with a series of slots 162 and 163 to receive the tab fingers 138 of the support beams 136 in securing the header to the webs 111.

Figure 12:
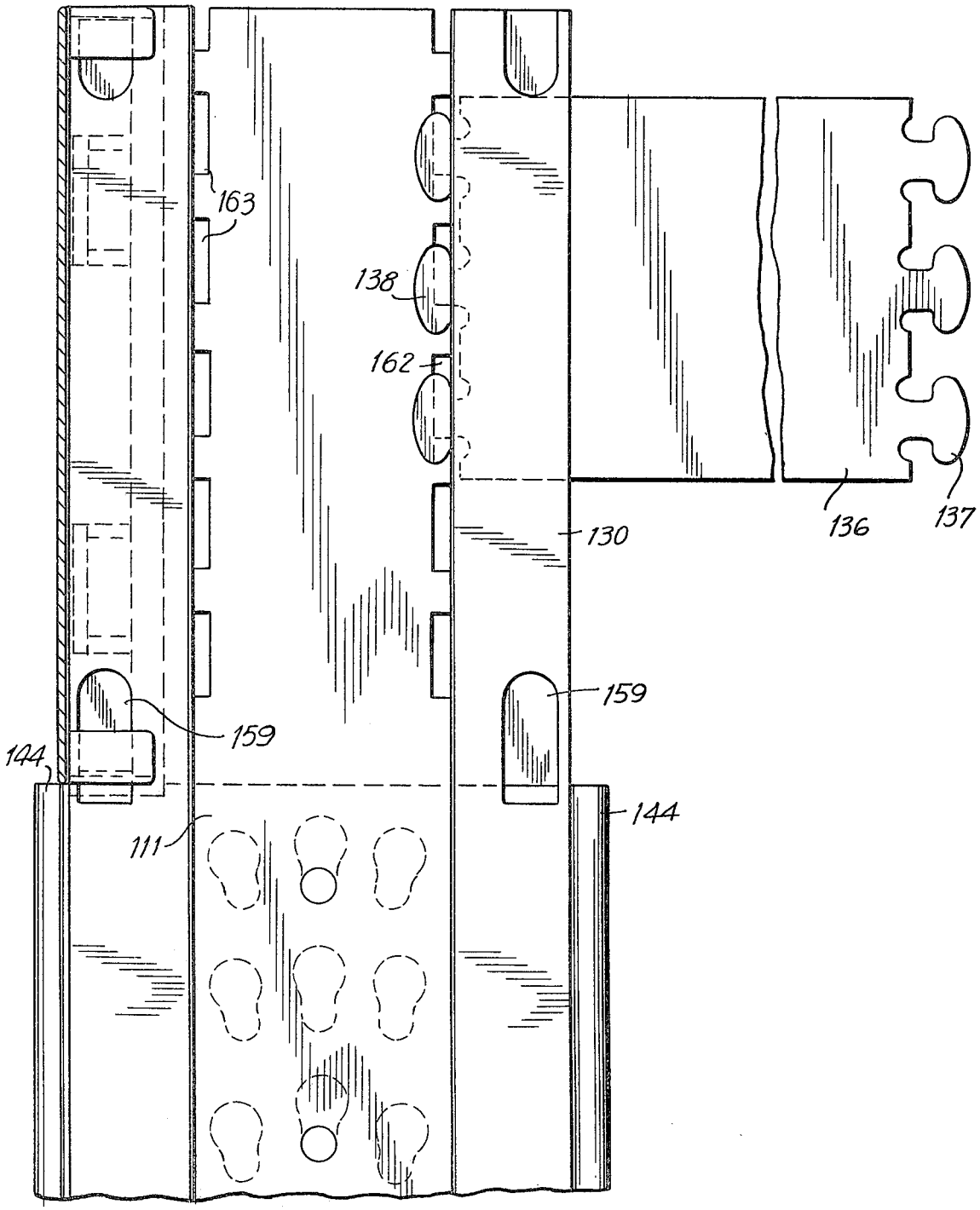
FIG. 12 is a partial side elevational view illustrating yet a further feature of the present invention relating to an extension of the web elements.

The manner in which the web extension 130 fits into the top of webs 111 is shown in more detail in FIG. 12.

Shelf Assembly

The shelf assembly 118 is shown in detail in the exploded perspective view of FIG. 15, and the shelf unit 119 is shown in relation to the webs in FIG. 14. As seen in these Figures, the shelf unit 119 includes a bottom section 120, which is formed by a grid-work of cross members 166 to provide strength and support to the shelf. A top cover 167 overlies the grid-work. A top surface 171, made of a thin sheet of polyester or polyethylene material, is provided with an arrangement of bumps or raised members 172 to minimize the surface contact between the bottom of a beverage bottle and the surface 171. In this manner, the friction forces between the bottom surface of a beverage bottle and surface 171 is minimized, so that when the shelf is tilted in a direction toward the front of the modular unit, a gravity feed capability will allow bottles from the rear to easily slide forward. This gravity feed arrangement allows beverage bottles to automatically slide forward to replenish removed bottles.

Side walls 168, 169, 170, etc. complete the formation of the shelf unit 119, and serve to hold the top sheet 171 and top cover 167 to the bottom section 120. No other fasteners for top sheet 171 and cover 168 are necessary. A cut-out 109 in side wall 169 (and the opposite side wall) serves to accomodate a web 111.

A price channel 214 may be provided along a front wall of shelf unit 119. Retailers will use the price channel 214 to insert pricing information.

A rail and divider arrangement 173 is preferably provided on top of each shelf unit. This arrangement includes front and rear rails 174 and 175, and side or end rails 176 to provide an enclosure on the top of each shelf to prevent bottles from sliding off the shelves. In addition, dividers 176' are provided on top of the shelves extending between the front and rear rails 174, 175 so as to provide channels or aisles within which beverage bottles can be maintained. Dividers 176' have snap hooks 206 to permit mounting and placement of the dividers 176' between the front and rear rails 174 and 175. Front and rear rails 174 and 175 each carry tabs 207 intended to be received in slots 208 in unit 119 to secure arrangement 173 onto shelf 119.

When mounted between the webs 111, end rail 176 (as seen in FIG. 2) may be used to cover an end of the shelf when such end is not adjacent another unit.

The top sheet 171 will also be held in place by the divider arrangement 173 without the need for additional fasteners.

The bottom section 120 of each shelf is provided with a pair of channel beams 177 and 178. The channel beams are preferably made of steel to provide strength to the shelf and means for supporting the shelf on the brackets. Channel beam retainer plates 215 are fastened by stakes 216 to the channel beams 177 and 178 to support the beams beneath the shelf unit 119.

The Brackets

Figure 16:
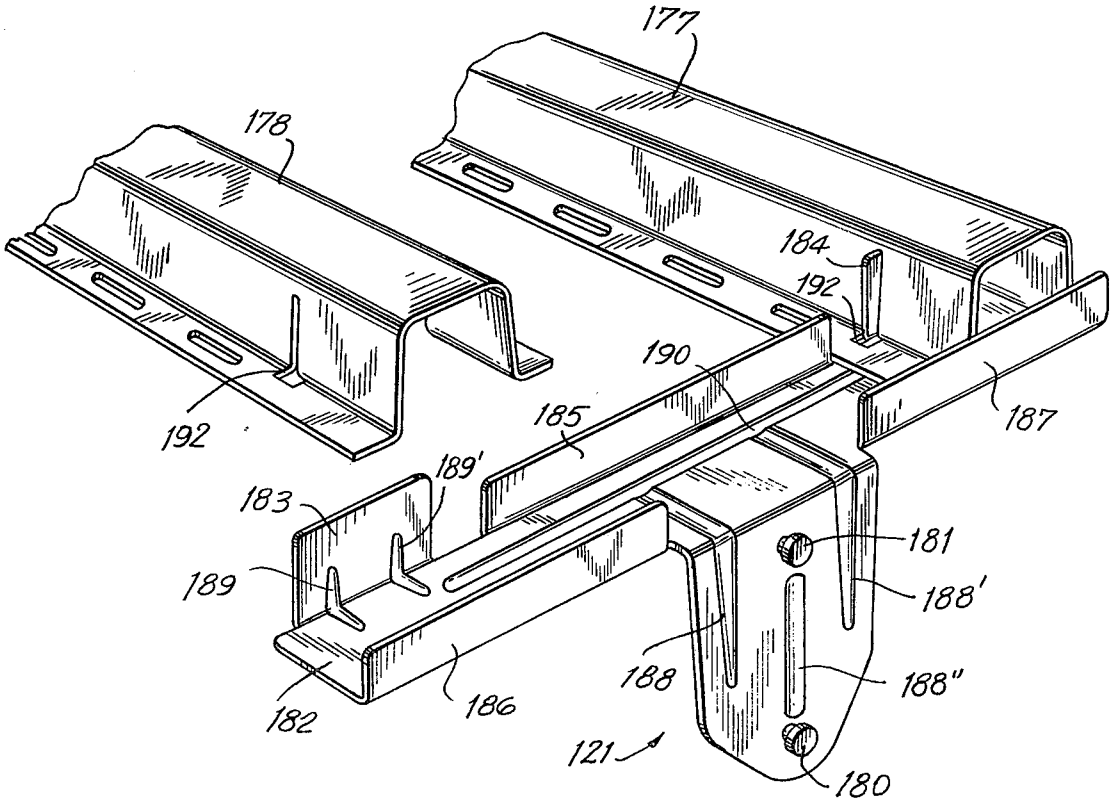
FIG. 16 is an enlarged perspective view illustrating one embodiment relating to a bracket for supporting a shelf assembly on the web system of the present invention.

As will be noted hereinafter, the brackets for supporting the shelf unit have a variety of designs. One such typical design is illustrated in FIGS. 14 and 16. In this embodiment, each bracket 121 has a mounting plate 179 which carries pins 180 and 181. Each of the pins has a flat top head 191 which serves as a stop when inserted into the keyholes 145, 146 or 147. The flat top head of each pin is of a diameter which allows insertion into the large ends of the keyhole. When the bracket is lowered so that the pin slides into the narrow end of the keyhole, the flat top head 191 will prevent removal from the keyhole. Each bracket 121 also is provided with a platform 182 which carries tabs 183 and 184. Walls 185, 186 and 187 provide additional means of support when engaging the shelf and the webs 111. The brackets 121 are also provided with a series of ribs 188, 188', 189' and 190 which provide additional means of structural support.

The channel beams 177 and 178 of each shelf have slots 190 for receiving the tabs 183 or 184 of each bracket. Accordingly, each shelf unit 119 is supported at two points along its width for stability. As can be seen from the drawings, the brackets 121 will support each shelf by engaging the channel beams on opposite sides of the shelf.

Ribs 188 and 188' are provided on mounting plate 179; 189 and 189' are provided on platform 182 and extend in a "L" shaped manner onto tabs 183 and 184; and rib 190 extends longitudinally along the platform 182.

Figure 27:
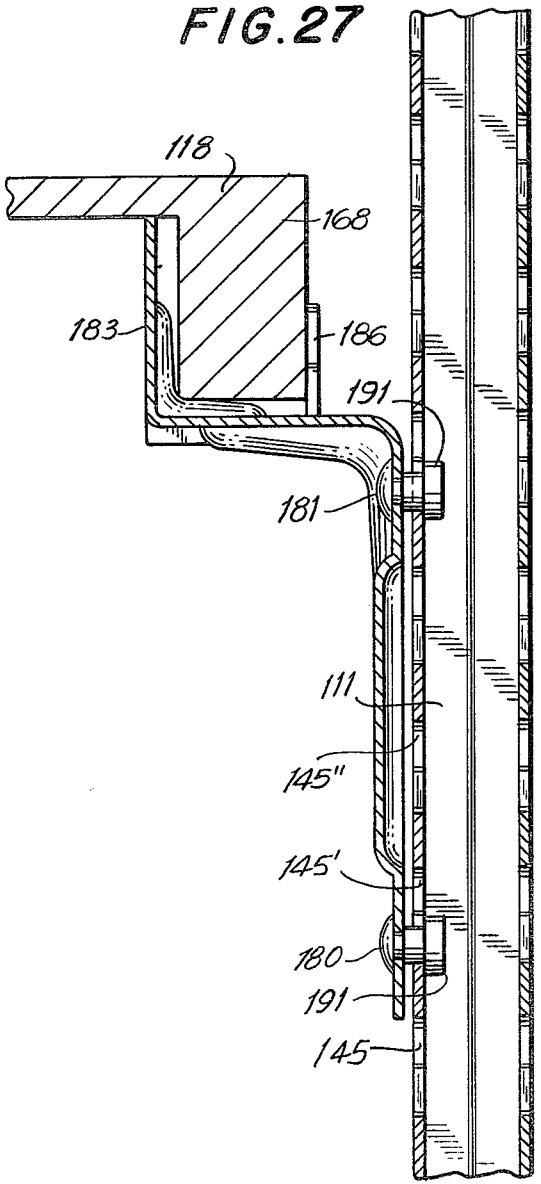
FIG. 27 is a sectional view taken along lines 27—27 of FIG. 26.
Figure 26:
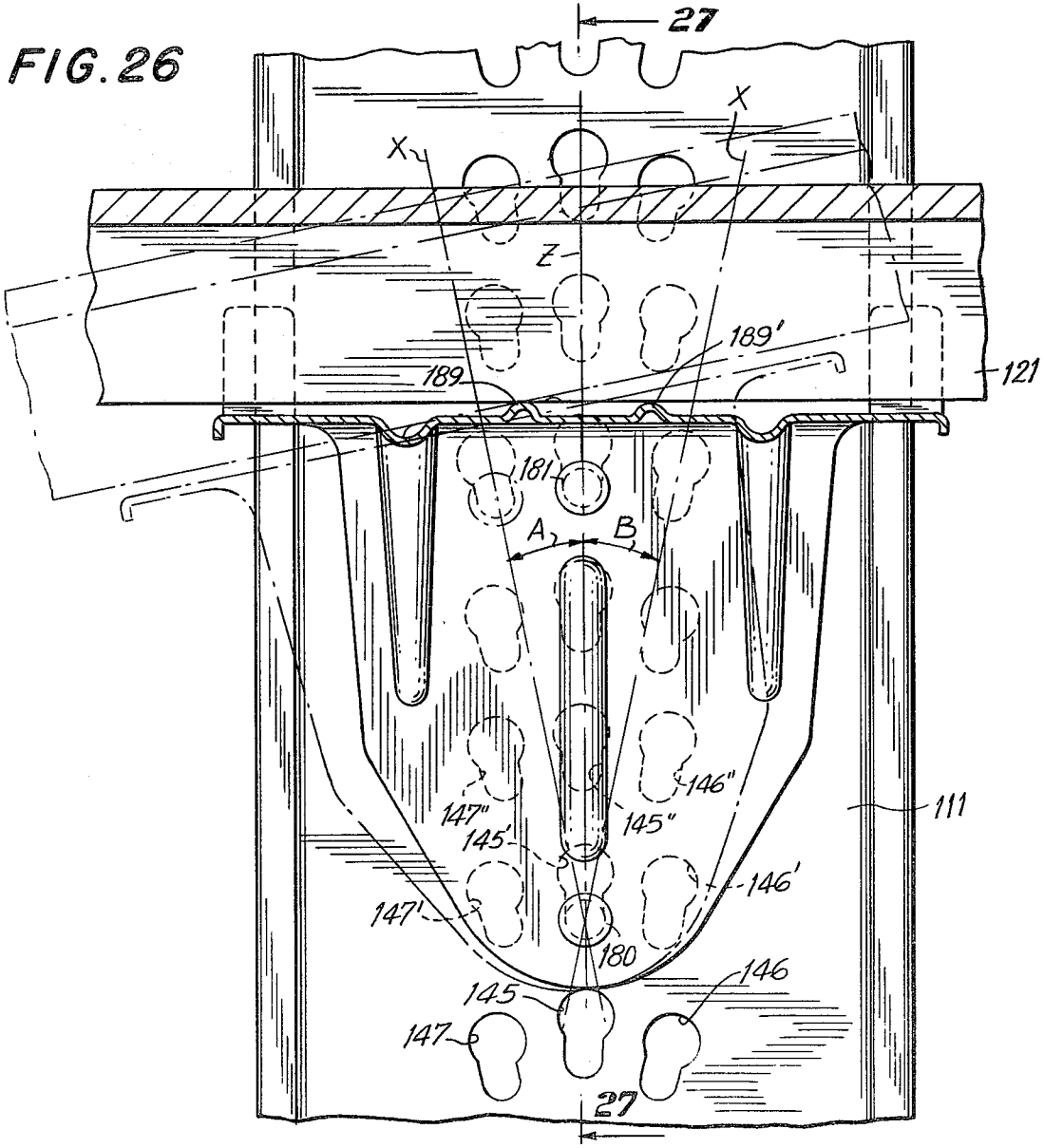
FIG. 26 is an enlarged side elevational view showing a variety of positions of which a shelf unit can be mounted on the web system.
Figure 28:
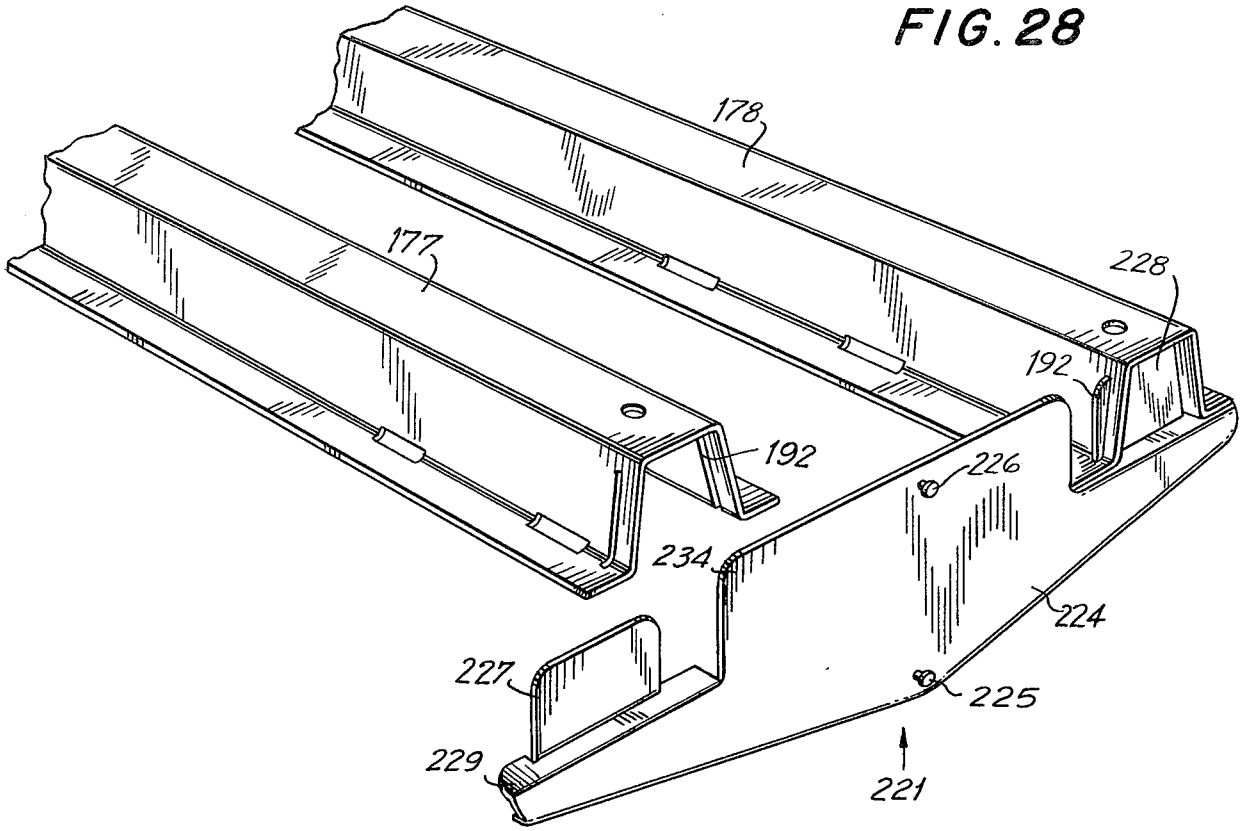
FIG. 28 is an enlarged perspective view illustrating a preferred embodiment of a bracket used in the present invention.
Figure 30:
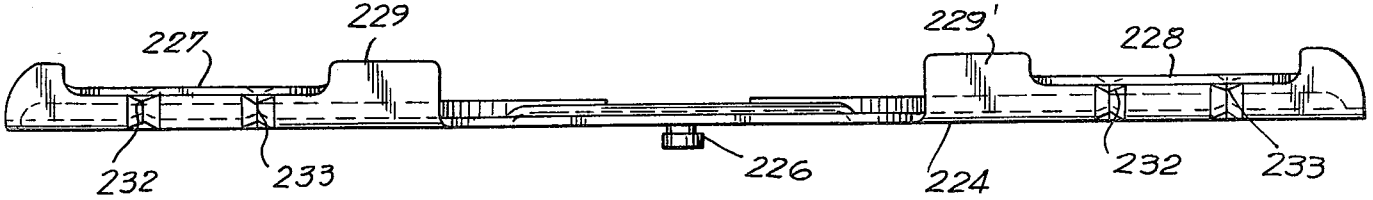
FIG. 30 is a top plan view of the bracket shown in FIG. 29.
Figure 29:
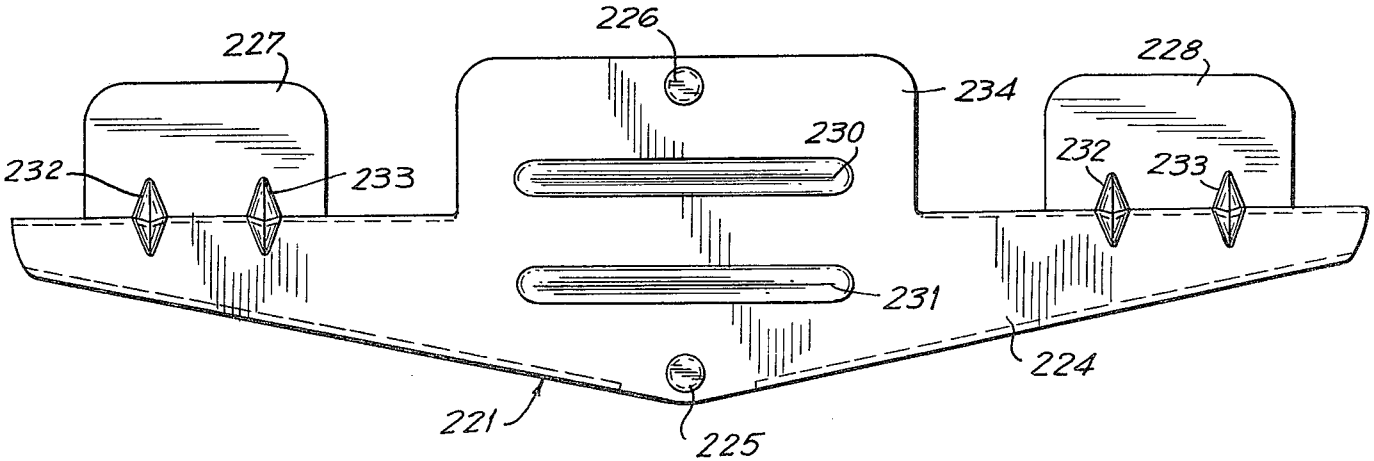
FIG. 29 is a side elevational view of the preferred embodiment of a bracket for use in the present invention as shown in FIG. 28.
Figure 31:
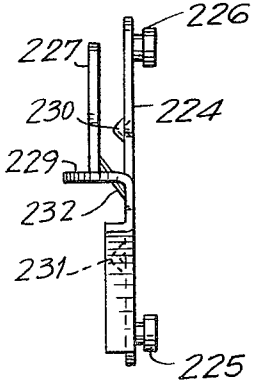
FIG. 31 is an end elevational view of the bracket shown in FIG. 29.

FIGS. 26 and 27 illustrate the manner in which the bracket 121 supports the shelf on the webs 111. As illustrated therein, pins 181 can be inserted through the large portion 145', 146' or 147', thus allowing the shank of the pin to drop into the narrow portion 145", 146", or 147" of the keyhole slot into which it is inserted. Flat top head 191 of each pin will thus engage the rear side of the slotted opening to prevent removal of the bracket. Shelf assembly 118 will thus rest upon the bracket being supported by ribs 189 with tabs 183 and 184 extending through the slots 192 on channel beams 177 and 178. The side walls 168 or 169 of shelf assembly 118 will thus be held in place on the bracket between walls 186 of the bracket and ribs 189.

As will also be appreciated from FIG. 26, shelf assembly 118 can be tilted either forward or rearward with respect to the longitudinal axis of webs 111 by inserting the lower pin through a central keyhole slot 145, and the upper pin 181 through one of the side keyhole slots, either 146 or 147. If both pins 180 and 181 were to be inserted and held in a central keyhole slot 145, the top surface 171 of shelf 118 would be maintained at a 90° angle with respect to the longitudinal axis of webs 111. If, however, it is desired to tilt the shelf assembly 118 toward the front or rear of the modular unit, the upper pin 181 will be inserted in one of the side keyhole slots, either 146 or 147. In this manner, the axis X of the bracket will be offset from the longitudinal axis Z of the webs 111 by angle A or B. An angle of tilt of between 5°–15°, and preferably 10°–12°, is expected to work well. This would provide a desired amount of tilt for the shelf and thus a proper gravity feed for the beverage bottles carried on the shelf.

The details of bracket 121 can be more fully appreciated from FIGS. 17, 18 and 19. The bracket shown therein can be referred to as a "double bracket" since it is provided with two separate tabs 183 and 184 for supporting a shelf 118 by engaging both channel beams 177 and 178. This type of bracket would be required when the modular unit has only a single web on each side, such as illustrated in FIGS. 1 and 2. However, as previously noted, the modular unit of the present invention can be provided with a pair of webs on each side, such as illustrated in FIG. 53(*a*). In this case, a "single bracket" having only a single tab for engaging only one of the channel beams of a shelf is required. An example of such a single bracket is shown in FIGS. 20, 21 and 22.

Figure 20:
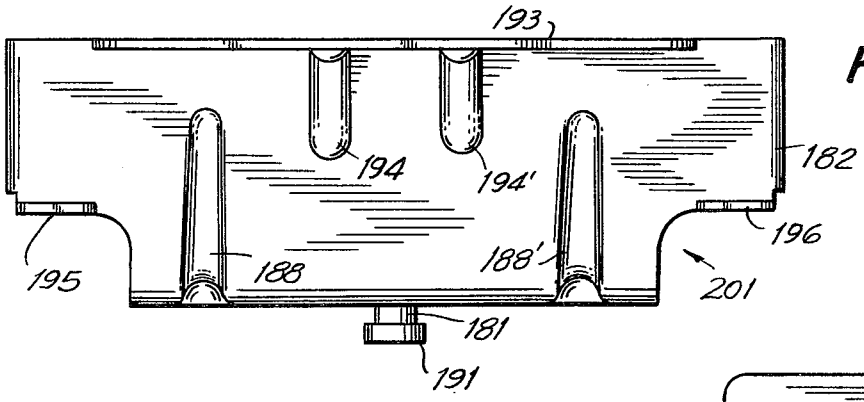
FIG. 20 is a top plan view of yet a further embodiment of a bracket used in the present invention.
Figure 22:
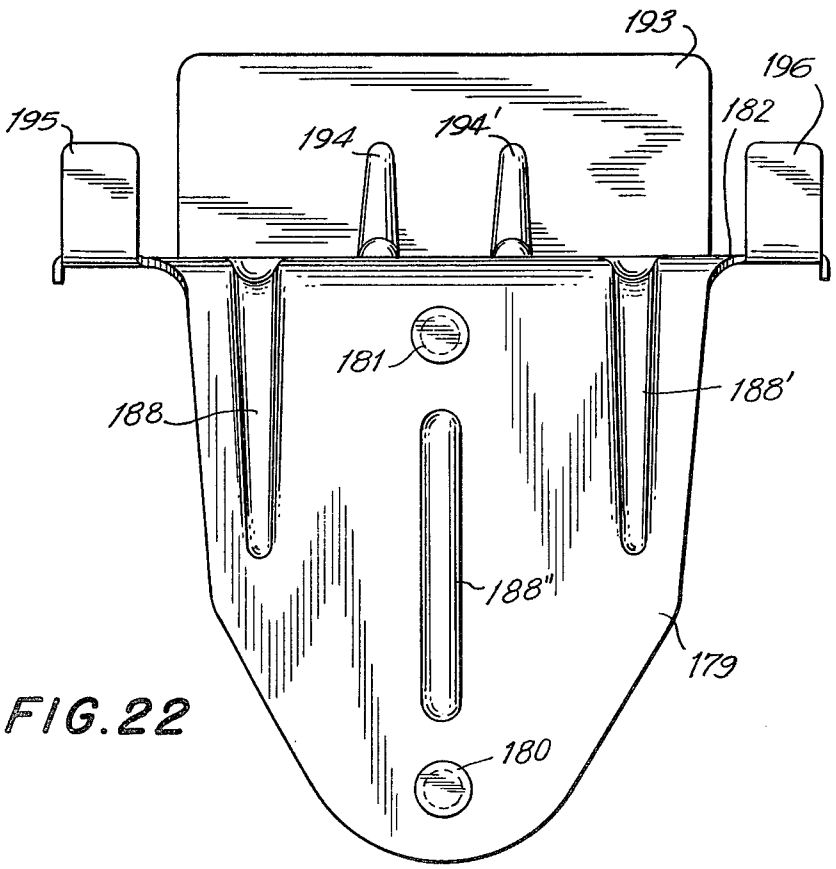
FIG. 22 is a front elevational view of the bracket illustrated in FIGS. 20 and 21.
Figure 21:
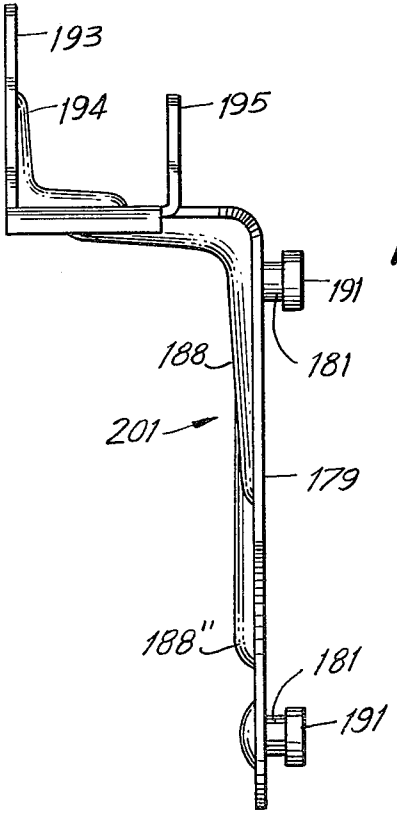
FIG. 21 is a side elevational view of the bracket illustrated in FIG. 20.

The single bracket 201, as illustrated in FIGS. 20 through 22, is similar to the double bracket, illustrated in FIGS. 17 through 19. Accordingly, like elements are shown has having like reference numerals. The single bracket has a mounting plate 179 with upper and lower pins 180 and 181, respectively. Each pin also has a flat enlarged head 191 and ribs 188, 188' and 188''. The single bracket of FIGS. 20 through 22 is similarly provided with a platform 182 for supporting the side walls of a shelf unit 119. Whereas, the double bracket of FIGS. 17 through 19 has a pair of tabs 183 and 184, the single bracket of FIGS. 20 through 22 has only a single tab 193. Single tab 193 has a length substantailly the same as each of the tabs 183 and 184, and is similarly intended to engage a slot 192 in one of the channel beams 177 or 178 of a shelf. Ribs 194 and 194' serve to provide additional structural support for tab 193 and to support the side wall of a shelf. Walls 195 and 196 extend upward from platform 182 on the single bracket, so that a wall of a shelf is secured between tab 193 and walls 195 and 196.

Figures 23, 24, 25:
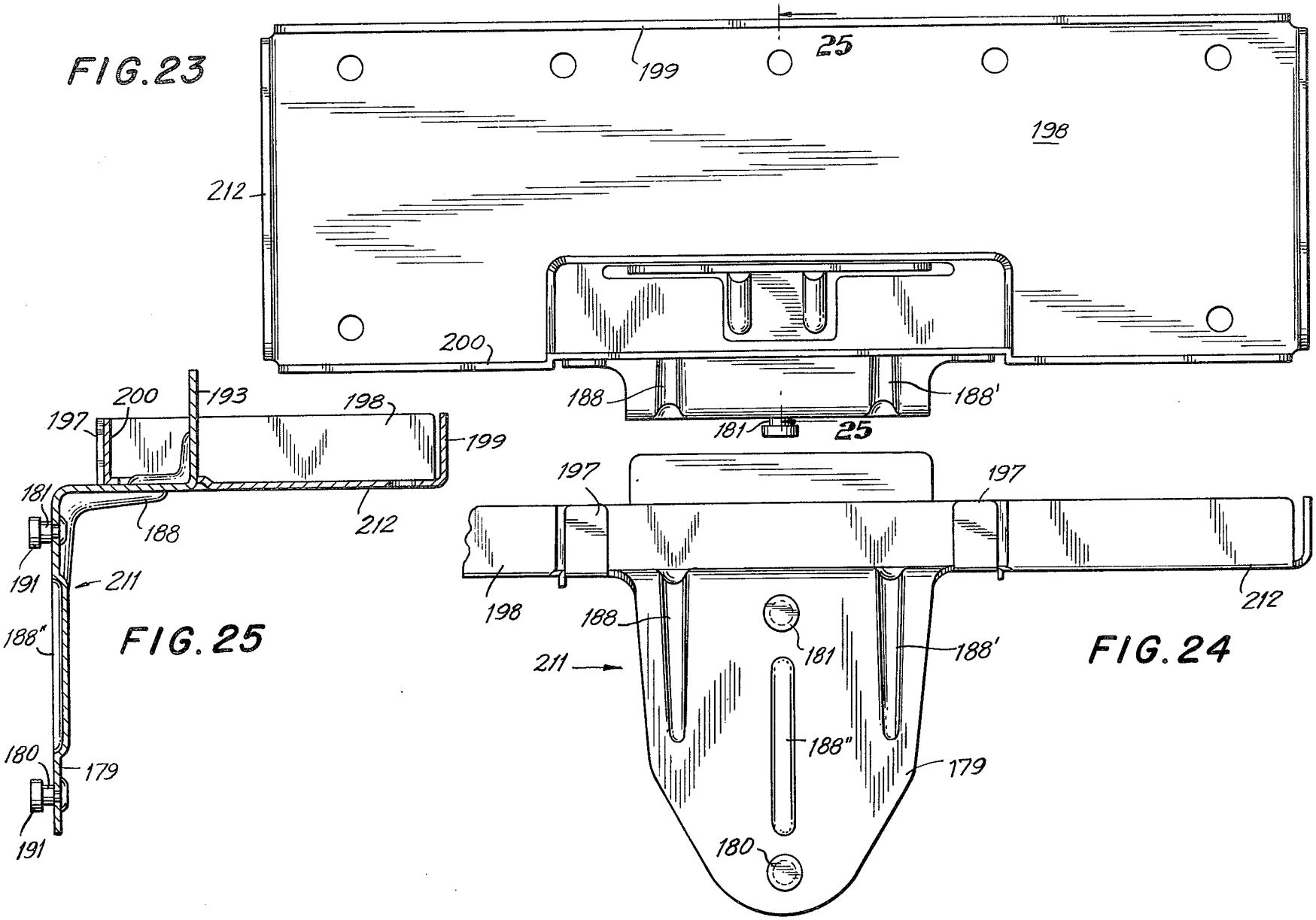
FIG. 23 is a top plan view of yet a further embodiment of a bracket used in the present invention.
FIG. 24 is a front elevational view of the bracket illustrated in FIG. 23.
FIG. 25 is a sectional view taken along lines 25—25 of FIG. 23.

Both the double bracket 121 and the single bracket 201 are intended for use to support opposite sides of one shelf between a pair (or two pairs) of webs 111. Although shelves 119 may be made and available in a variety of sizes, such as 24 inches deep and 30 inches long, 36 inches long, 48 inches long, etc., the present invention contemplates the availability of a shelf which is only 6 inches long, and would thus be supported by only one bracket on one side thereof. In other words, the 6 inch shelf would be cantilevered from only a single web (or single pair of webs) without support on the opposite side. For this situation, a cantilever bracket 211, illustrated in FIGS. 23, 24 and 25 is provided. Bracket 221 is of the single bracket type, but may similarly be provided in a double bracket type.

Bracket 211 thus also has mounting plate 179; pins 180 and 181; ribs 188, 188' and 188''; and a tab 193 for engaging a slot 192 in one of the channel beams 177 or 178. Walls 197 and 198 are also provided to engage and support a shelf 118. Unlike brackets 121 and 201, however, the bracket 211 is provided with an extended and enlarged platform 212, which preferably extends the full width of the 6 inch shelf (shown schematically as 198 in FIGS. 23 through 25). Platform 212 is also provided with upstanding walls 199 and 200 in order to extend upwardly on opposite sides of the 6 inch shelf.

While reference has been made to a 6 inch shelf, it should be fully understood and appreciated, that a variety of narrow length shelves can be provided and supported by a brackets of the type illustrated in FIGS. 23 through 25.

The embodiments of the brackets 121, 201 and 211, described hereinabove, have the common features that pins 180 and 181 are located below the supporting platform. A preferred form of bracket, however, in which one pin is located below the supporting platform and the other pin located above the supporting platform, in order to distribute the bending forces more uniformly across the mounting plate 179, is shown and illustrated in the embodiments for a double bracket 221, illustrated in FIGS. 28 through 31; the single bracket 222, illustrated in FIGS. 41 through 43; and the cantilever bracket 223; illustrated in FIGS. 43 through 45.

Turning now to the double bracket 221 and FIGS. 28 through 31, a mounting plate 224 carries lower and upper mounting pins 225 and 226. Bracket 221 also has upstanding tabs 227 and 228 to engage with slots 192 on the channel beams 177 and 178 of a shelf. Bracket 221 is also formed with a platform 229 and 229', upon which, the walls of the shelf come to rest. In a manner similar to the double bracket, shown in the embodiment of FIGS. 16 through 19, the bracket 221 is provided with inwardly extending ribs 230 and 231 on the mounting plate for structural rigidity and for engaging a surface of one of the walls of the shelf. Similarly, ribs 232 and 233 structurally support tabs 227 and 228, and also serve to engage a wall of the shelf.

Unlike bracket 121, shown in the embodiment of FIGS. 16 through 19, bracket 221 has an upwardly extending extension 234 on the mounting plate 224. Pin 226 is carried on the extension 234. In this manner, one of the pins is located above platform 229, and the other pin is located below platform 229. In the embodiment of brackets 121, 201 and 211, pins 180 and 181 were both located below the platform of their respective bracket, so that the bending moment created on the mounting plate 179 was increased by the force acting on each pin. The bending moment acting on mounting plate 224, however, is more evenly distributed as a result of extending the mounting plate 224 through extension 234, and having one of the pins located above the platform.

Figure 34:
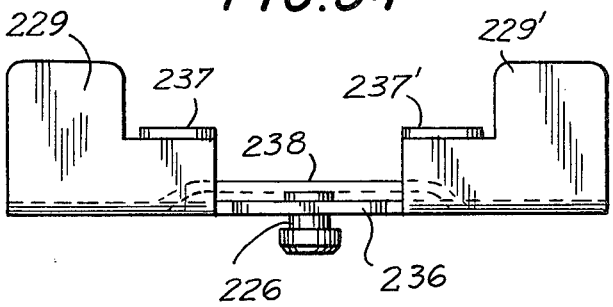
FIG. 34 is a top plan view of the bracket shown in FIG. 32.
Figure 33:
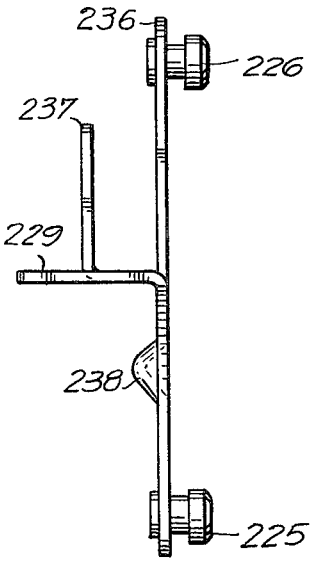
FIG. 33 is a side elevational view of the bracket shown in FIG. 32.
Figure 32:
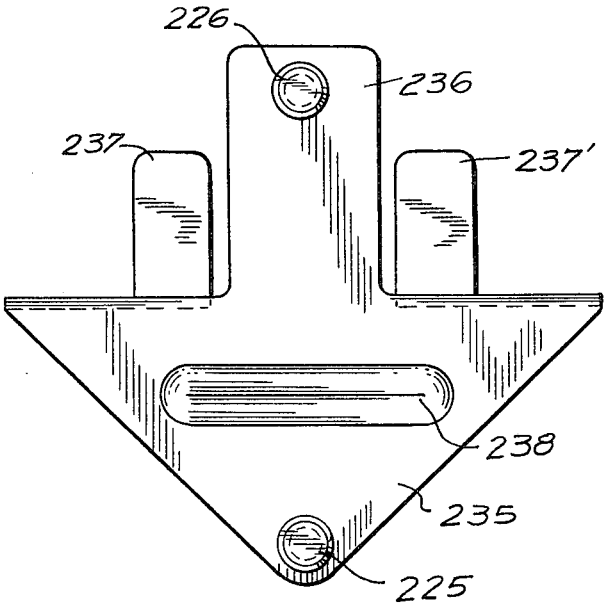
FIG. 32 is a front elevational view of another embodiment of a bracket for supporting the shelf in the present invention.

The single bracket 222, illustrated in the embodiment of FIGS. 32 through 34, also has a mounting plate 235 with an extension 236. Lower and upper pins 225 and 226 are similarly carried below and above a platform 229 and 229' with upper pin 226 being carried on the extension 236. A bifurcated tab 237 and 237' is similarly arranged to engage a slot 192 on one of the channel beams of a shelf. Both tabs 237 and 237' will engage the same slot. A structural rib 238 is also provided on the mounting plate 235.

Figure 37:
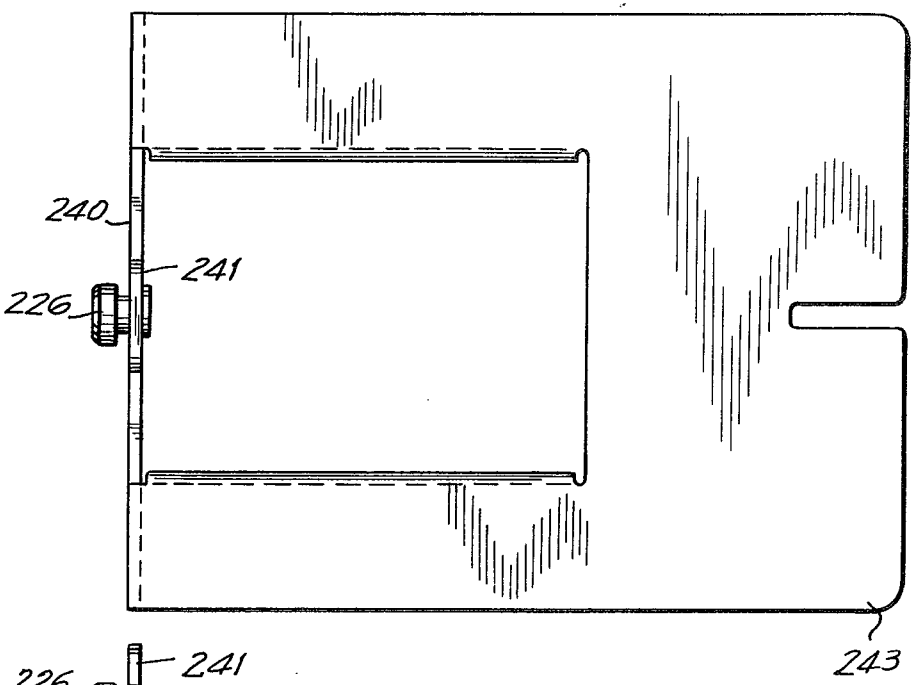
FIG. 37 is a top plan view of the bracket shown in FIG. 35.
Figure 36:
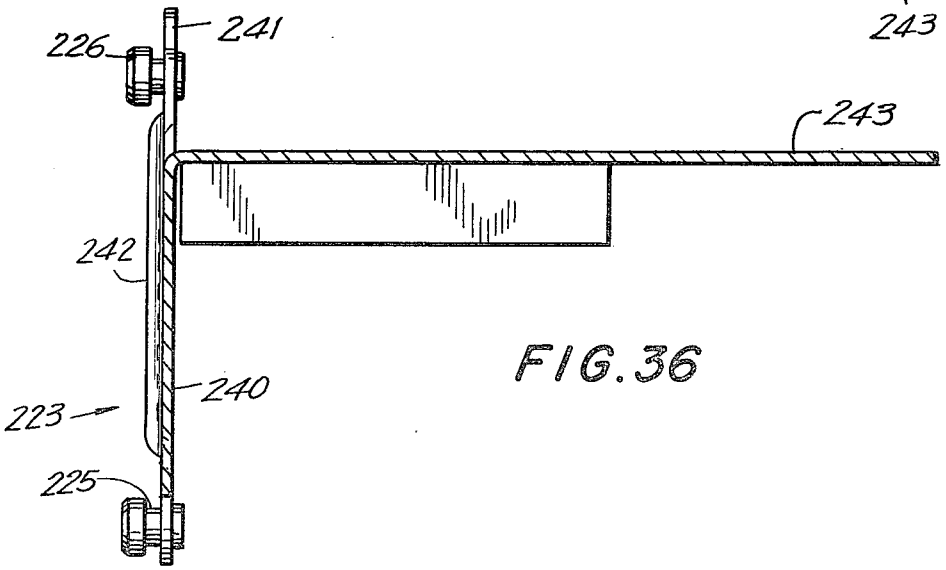
FIG. 36 is a side elevational view of the bracket shown in FIG. 35.
Figure 35:
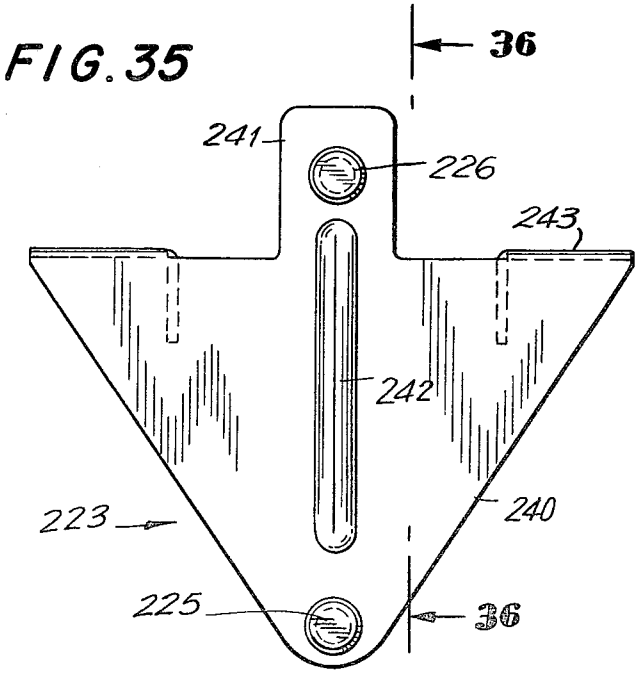
FIG. 35 is a side elevational view of yet a further embodiment of a bracket for use in the present invention.

The cantilever shelf 223, illustrated in the embodiment of FIGS. 35 through 37, similarly has a mounting plate 240, and an extension 241 which carries an upper pin 226. Lower pin 225 is carried on the mounting plate 240. A single rib 242 is carried by the mounting plate 240. An extended and enlarged platform 243 provides support for a narrow length shelf.

Bottom Wedge Arrangement

With reference to FIGS. 38 through 40, one embodiment of a bottom and back wedge arrangement is illustrated. As depicted in FIGS. 1 and 2, a bottom wedge shaped shelf 122 is arranged to fit within the base assembly 116 for supporting and stacking a variety of beverage products, whether they be carried in separate cartons or individually. Wedge shaped shelf 122 is preferably made of a high impact plastic, such as polypropylene, polyethylene or polystyrene, since it typically must have high strength characteristics in order to withstand the possibility of people stepping on it, which is often the case in supermarkets when people are attempting to reach higher shelf levels. The shelf 122 has front end 245 which is thicker than the rear end 246. Therefore, the shelf 122 has a slight rearward tilt in order to prevent items stored on it from falling toward the front. The shelf, illustrated in FIGS. 38 through 40, has generally a flat top surface 247 to support the beverage bottles. Shelf 122 is supported on a series of support blocks 248 which fit within the base assembly 116 with front end 245 arranged toward the front of the modular unit, and rear end 246 arranged toward the rer of the modular unit. A series of longitudinally extending guide slots 249 are provided toward the front end of the wedge shaped shelf 122. One of the guide slots 249 will interlock with the top edge of front kick plate 114. A rear guide slot 250 is arranged toward the rear end 246 of shelf 122, so as to interlock with the top edge of rear kick plate 115. In this manner, the wedge shelf 122 is securely positioned within the base, and serves to additionally structurally support the modular unit by interlocking the front kick plate with the rear kick plate. Side walls 251 and 252 of shelf 122 are dimensionally spaced, so as to fit between the webs 111.

Back wedge 123 has a top end 253, which is narrower than the bottom end 254. The side walls 255 and 256 will dimensionally correspond with the distance between the side walls 251 and 252 of shelf 122. Back wedge 123 is intended to rest on the rear end of shelf 122 as a back stop and as a support for items carried on the surface 247 of shelf 122.

Back wedge 123 and bottom wedge 122 are preferably interlocked together. One form of interlocking arrangement is illustrated in FIGS. 38 through 40, and includes a key and keyway arrangement. A series of keys 258, having a shank portion 259 and an enlarged head portion 260, depend from the back wedge 123 at the juncture between bottom end 254 and front surface 257. Wedge shaped shelf 122 is provided with a series of keyway slots 263. Each slot has an enlarged opening 264 for receiving the head portion 260 of each key 258, and a narrow extended guideway slot 265 for receiving the shank portion 259 of each key.

As illustrated in FIGS. 39 through 40, in order to assemble back wedge 123 with wedge shelf 122, wedge 123 is tilted in a forward direction (arrow F), so that head portion 260 can be inserted into the enlarged openings 264. Thereafter, back wedge 123 will be tilted rearwardly, so that its bottom 254 rests upon the surface 247 of shelf 122. The wedge 123 can then be slid rearwardly on the surface 247 with shank portions 259 being guided in the guideway slot 265.

To prevent undesired movement of the wedge 123, the under surface of shelf 122 is provided with a ratchet arrangement, formed by a plurality of downwardly depending teeth 267, which extend longitudinally transversely of the guideway slots 265. Shank portion 259 of each key 258 is arranged at an angle with respect to front surface 257, and head portion 260 is triangularly shaped, so that when the wedge 123 sits on the surface 247 of shelf 122, a corner 261 will be positioned between a pair of teeth 267. Further movement of wedge 123 along shelf 122, will thus be prevented by corner 261 engaging one of the teeth 267. In order to remove or reposition wedge 123 it will be necessary to tilt wedge 123 in the direction of arrow F so as to disengage corner 261 from the teeth 267. Shank portion 259 of each key 258 can then freely ride in the guideway slot 265.

Figure 41:
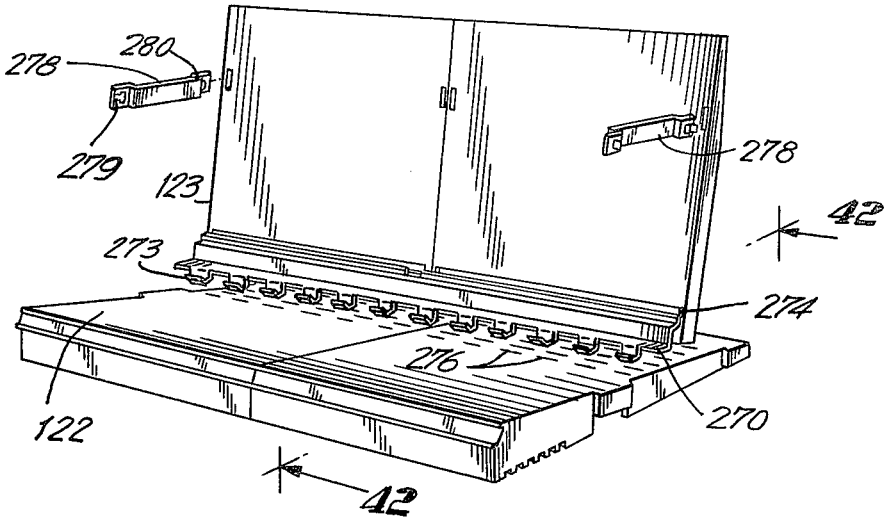
FIG. 41 is a perspective view illustrating a preferred bottom and back wedge arrangement.
Figure 42:
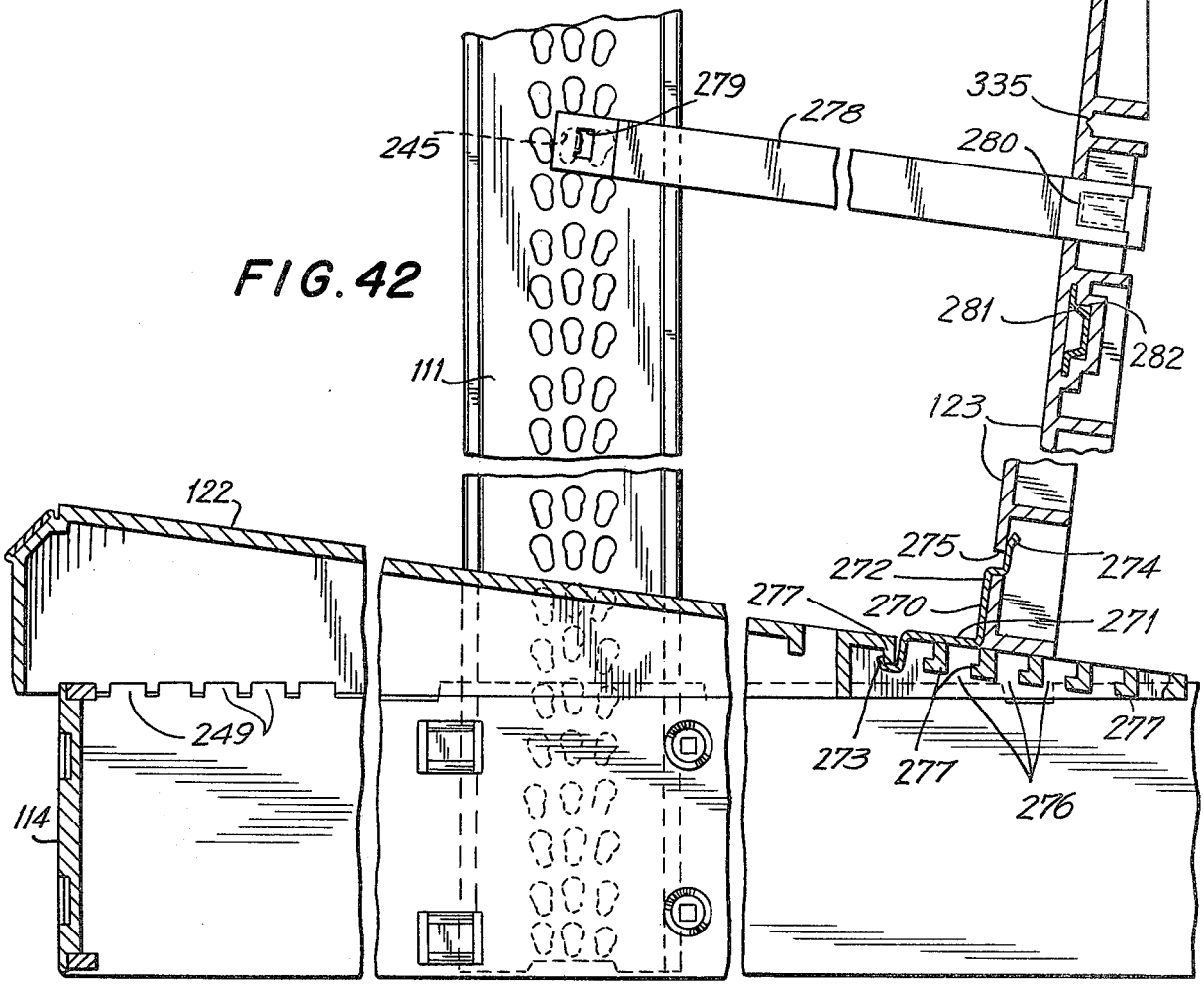
FIG. 42 is a sectional view taken along lines 42—42 of the embodiment of FIG. 41.

The wedge arrangement, illustrated in FIGS. 2, 41, 42, 43 and 44, similarly has a bottom wedge shelf 122 and a back wedge 123. Each are made of molded high impact polypropylene, polyethylene or polystyrene with bottom shelf 122 supported between the front and rear kick plates 114 and 115, in a manner similar to that illustrated in FIGS. 38 through 40. The arrangement of FIG. 41 illustrates a preferred method of assembling by using a joiner element 270, illustrated in cross section in FIG. 42, and in front and top plan views in FIGS. 43 and 44, respectively.

Joiner element 260 has a generally L shaped cross section, formed of legs 271 and 272. A plurality of hooks 273 are carried at the distal end of leg 271. The distal end of leg 272 is provided with an L shaped lip 274, which extends the full length of joiner element 270. A slot 275 is provided on the back wedge 123 running substantially the full width of the wedge to accomodate lip 274. Bottom wedge 122 is provided with a plurality of longitudinally extending slots 276 to receive the hooks 273. The front end of each slot 276 is provided with a depending finger 277 to which hook 273 is coupled. In this manner, forces acting at the distal end of legs 271 and 272, on the hook member 273 and lip member 274, respectively, serve to securely support the back wedge 123 on the wedge shelf 122. For additional support, however, a brace 278 can be provided between back wedge 123 and each of the webs 111 on each side of the modular unit. Accordingly, brace 278 is provided on one end thereof with a hook member 279 intended to engage one of the center keyhole slots 145. At the other end of brace 278 is located a hook or other locking member 280, arranged to engage a lip on back wedge 123. A brace 278 may be provided on each side of the back wedge 123.

Additionally, a hat shaped stiffener element, preferably made of spring steel 281, can be provided in a channel 282 of the back wedge to provide additional strength characteristics. A break-away notch 335 may be provided on back wedge 123 to allow breaking a top portion of the back wedge away from the remainder of the back wedge to shorten it.

Base Assembly

A preferred embodiment for interconnecting the webs 111 with the feet 112 is illustrated in FIGS. 45, 46, 47 and 48. In this arrangement, a web 111 is supported in foot 112, which is a duct-work member formed between substantially identical interlocking halves 285 and 286. A first set of conically shaped recessed locking screw holes 287 and 288 are formed in half 285, and identical holes 287' and 288' are formed in half 286. When the halves are assembled recesses 287, 287', 288 and 288' are aligned facing each other. A nut and bolt arrangement 218, 219 can then be used to secure halves 285 and 286 together. A second set of indentations 290, 290', 291 and 291' are formed in halves 285 and 286. When the nuts and bolts are tightened, the conical surfaces 350 of recessed screw holes 287, 287', 288 and 288' will engage shoulders 144' of webs 111. As the bolts are further tightened, engagement of shoulder 144' against the conical surfaces 350 will cause web 111 to move toward and ultimately into engagement with indentations 290, 290', 291 and 291'. In this manner, the webs 111 will be securely positioned between the halves 285, 286 of foot 112, and thus, maintained in an upright position.

Each half 285 and 286 has interlocking bent over side walls 289 and 289', and bent over interlocking end walls 292 and 292'. Tabs 294, 294' each have a guide cut-out 295, 295', respectively, formed out of the side walls 289, 289'. When assembled, tabs 294 of half 285 will overlap with tabs 294' of half 286, and their respective guide cut-outs 295, 295' will similarly overlap to form a guideway to receive and securely hold webs 111 by accomodating the crimped over ends 144. Also, when web 111 is inserted into foot 112 by sliding crimped over ends 144 into the guideways 295, 295', the ends 144 will also abut against indentations 290, 290', 290 and 291' on one side, and 287, 287', 288 and 288' on the other side, so as to form a secure holding arrangement for the webs 111.

Foot 112 can additionally be secured together by welding sides 289, 289', 292 and 292' together.

Figures 43, 44, 48:
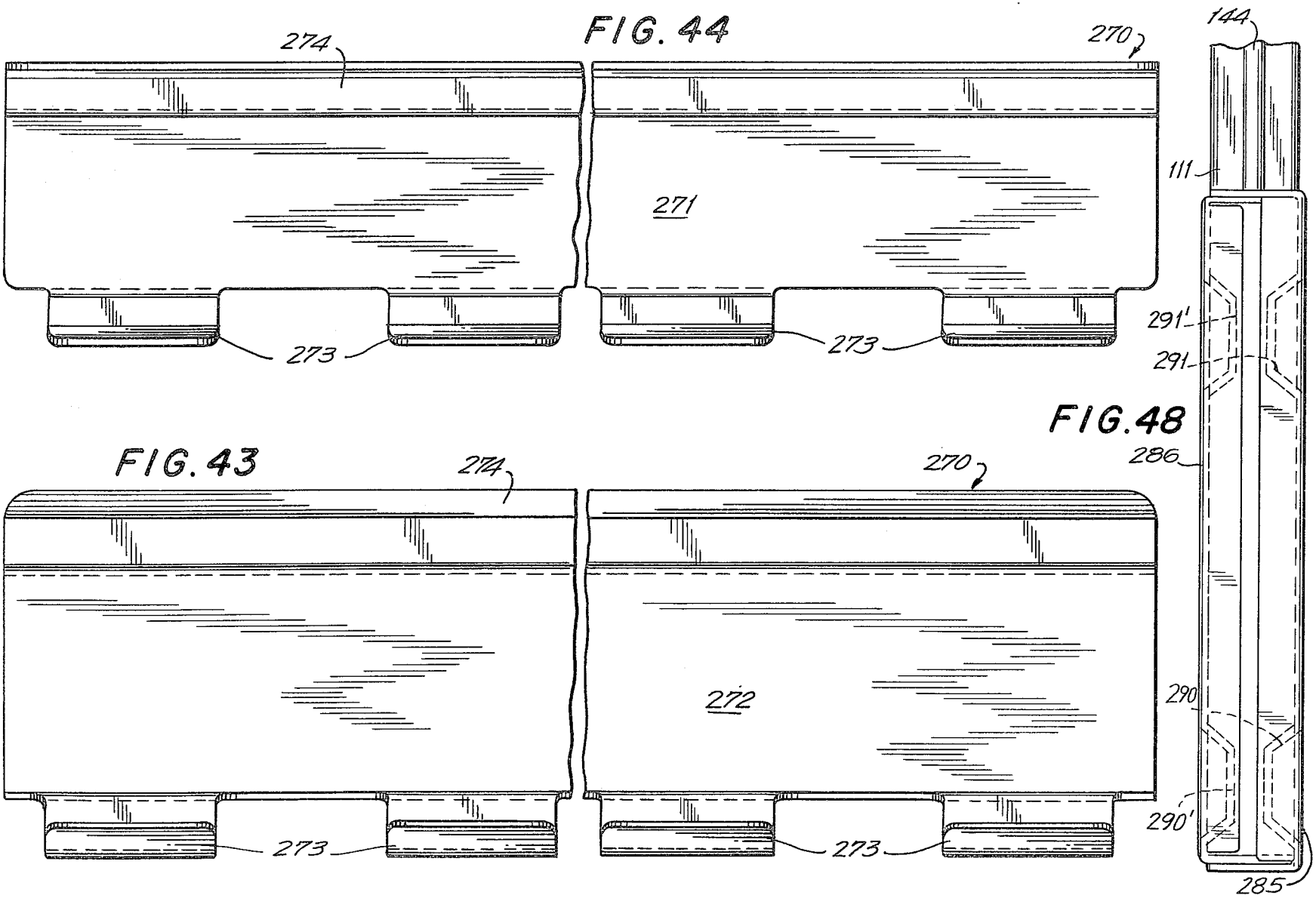
FIG. 43 is a front view taken in the direction of arrow 43 in FIG. 42.
FIG. 44 is a plan view taken along the direction of arrow 44 of FIG. 42.
FIG. 48 is an elevational view taken along arrow 48 of FIG. 45.
Figure 45:
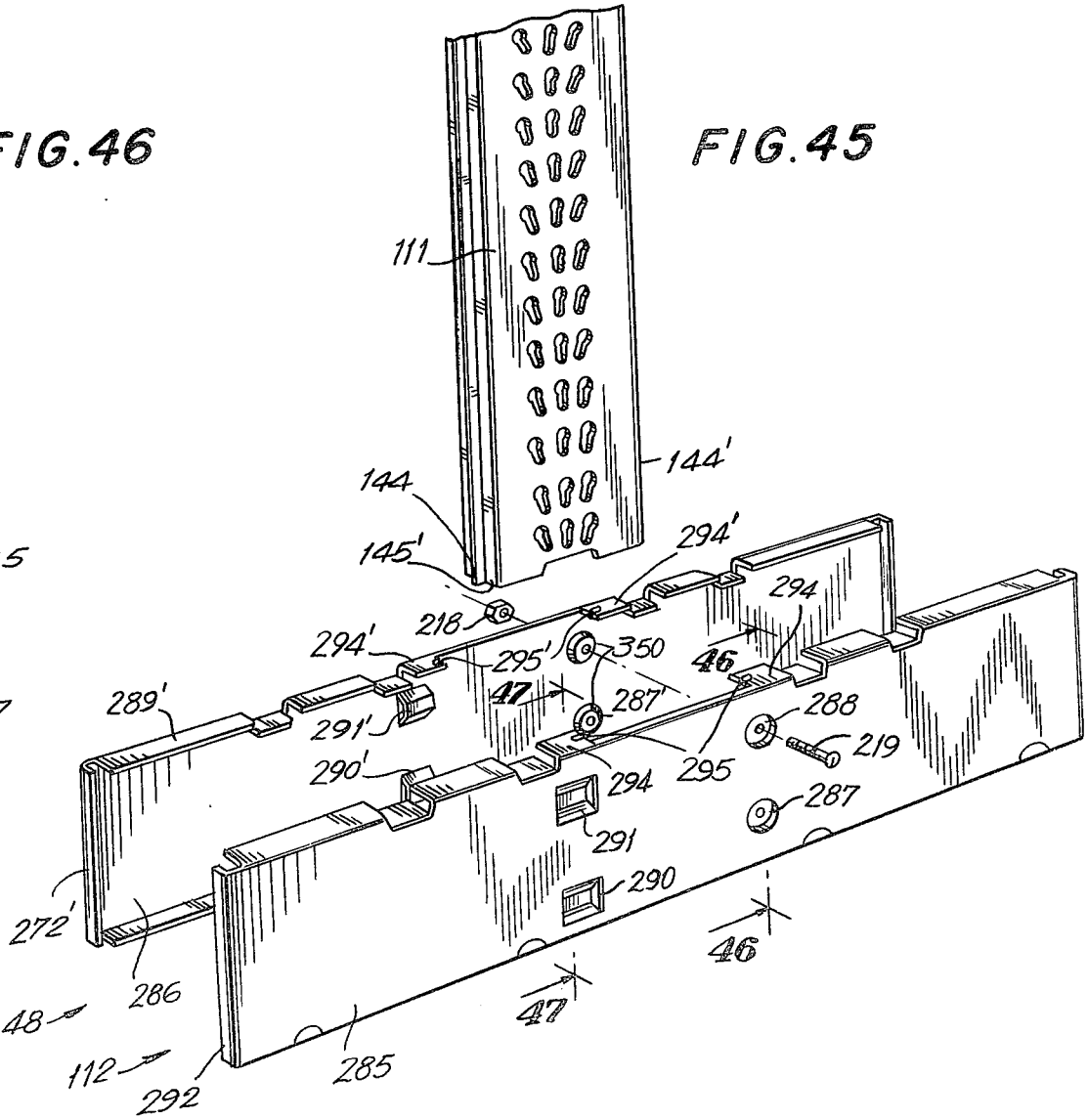
FIG. 45 is an enlarged and exploded perspective view showing in detail the coupling between a web member and foot member.
Figure 46:
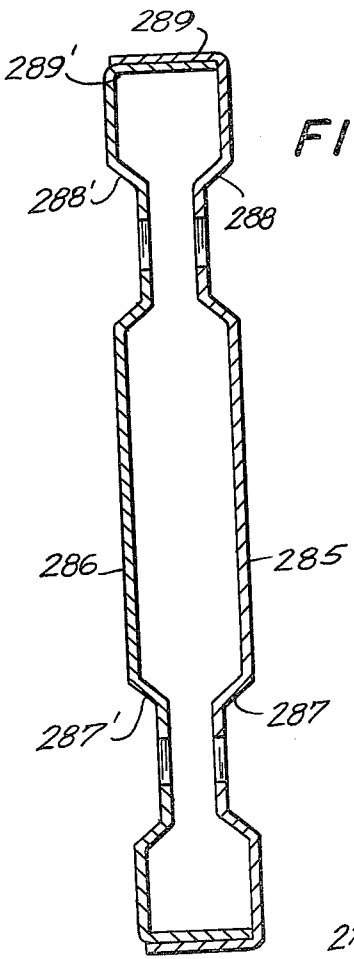
FIG. 46 is a sectional view taken along lines 46—46 of FIG. 45.
Figure 47:
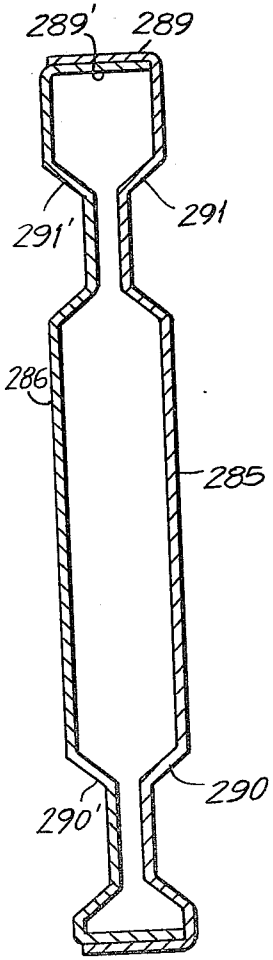
FIG. 47 is a sectional view taken along lines 47—47 of FIG. 45.
Figure 49:
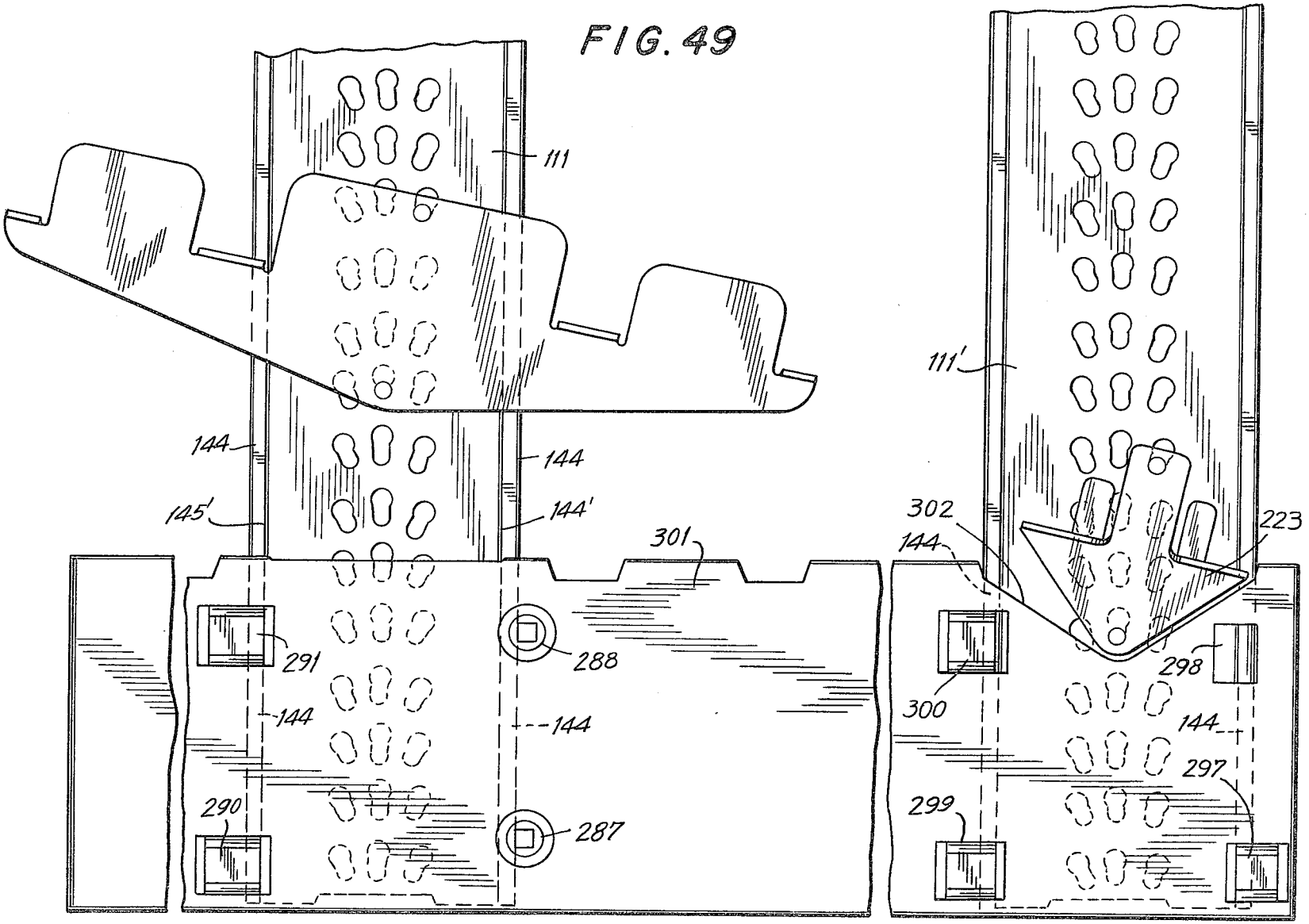
FIG. 49 is a side elevational view of a modified embodiment shown in FIG. 43.

The foot member 112, shown in FIG. 45, will most likely be approximately 24 inches long, and will be used in a modular unit in which the shelves are 24 inches in depth. It is contemplated, however, that shelves having a depth of 30 inches, or greater, will also be used. For this purpose, a foot having a length of 30 inches will be required. FIG. 49 illustrates a typical long length foot for use with deeper shelves. In this situation, foot 301 is arranged to support two separate webs 111 and 111' on each side of the modular unit. Feet 301 generally have the same construction as illustrated in FIGS. 45 through 48 with conically shaped recesses 287 and 288, and indentations 290 and 291 forming guide channels to receive and be urged against shoulder 144' and 145' respectively. A further set of indentations 297, 298, 299 and 300 serve to form guide channels to receive a second web 111'.

Foot 301 is also provided with a cut-out 302 intended to accomodate the single cantilever bracket 223 at its lower most position on web 111'.

Another arrangement of assembling a web 111 with a foot 112 is illustrated in FIG. 50. In this arrangement, webs 111 are detachably connected to the foot member 112 by use of a pair of legs 283. Legs 283 engage openings 284 in the feet 112 within which ribs 319 form guide channels for the legs 283.

A variety of means can be used to interconnect the front and rear kick plates with feet 112. One such typical arrangement is illustrated in FIG. 50 by the use of slots 320 to receive tab fingers which are carried on the end of the kick plates. The preferred means, however, is by the use of ends 129 illustrated in FIGS. 2 and 3(*b*) in connection with the description of center beam 28. As noted above, the kick plates and the center beam 128 can be of identical construction. Accordingly, the ends 129 of the kick plates will engage with the vertical slots in the ends of feet 112 as shown in FIG. 2.

From the foregoing description, it will be appreciated that a novel construction has been devised to permit versatility in creating beverage display units, which can be used in a variety of situations. FIG. 51 illustrates the versatility of the present invention. In this arrangement, a plurality of modular units 110(*a*), 110(*b*), 110(*c*), 110(*d*) and 110(*e*) are arranged in an "L" shaped pattern. End units 110(*a*), 110(*e*), and center unit 110(*c*) are provided with base assemblies 116 and with header assemblies 117. Units 110(*b*) and 110(*d*) are not provided with base or header assemblies.

Unit 110(*a*) includes webs 303 and 304, center unit 110(*c*) is formed by webs 305 and 306 on opposite sides of the unit with an additional web 307 located on a third side to form part of unit 110(*d*). In all other respects, center unit 110(*c*) is of identical construction to the other units. End unit 110(*e*) is formed by webs 308 and 309. Intermediate unit 110(*b*) is formed by webs 304 and 305, and intermediate unit 110(*b*) is formed by webs 307 and 308. Shelves 118(*a*), supported on webs 303 and 304, may be of a standard size, such as 24 inches deep and 24 inches long. As illustrated in the Figures, these shelves are arranged with their major surface perpendicular to the longitudinal axis of the webs 303 and 304, and their brackets, therefore, have pins which rest in the central keyhole slots of the webs. Similarly, shelves 118(*c*) of center unit 110(*c*) may also be of a small or standard size, and also arranged with their major surface perpendicular to the longitudinal axis of their webs. The shelves 118(*e*) of end unit 110(*e*) may be of a different size and tilted forward by an amount of between 5° to 15°, so that the brackets supporting these shelves have the lower pin positioned in a central keyhole slot of the web, and the upper pin positioned in a forward side keyhole slot. The shelves 118(*b*) and 118(*d*) of the intermediate unit, may also be tilted forward, but may be of substantially longer length than the shelves of the other units, such as a 48 inch standard size.

Another arrangement of modular units is illustrated in FIGS. 52(*a*) and 52(*b*). In this arrangement, end units 110(*f*) and 110(*g*) are formed by webs 311 and 312, and unit 110(*g*) is formed by webs 313 and 314. These units support shleves 118(*f*) and 118(*g*). These shelves can be arranged at any desired height or tilted forward. An intermediate unit 110(*h*) is formed by longer shelves 118(*h*), supported between the webs 313 and 313. Accordingly, as will be appreciated from the present arrangement and from previously described structure, adjacent units, such as 110(*f*) and 110(*h*), will have their respective shelves supported by common webs, in this case webs 312. The arrangement of FIGS. 52(*a*) and 52(*b*) is an in-line arrangement, as distinguished from the corner arrangement of FIG. 51. Additionally, a cantilever shelf 118(*i*) may be supported on a common web 314 by one of the cantilever brackets 211 or 223.

FIGS. 53(*a*) and 53(*b*) illustrate yet a further possible arrangement using the present invention. In this in-line arrangement, end units 110(*k*) and 110(*j*) support shelves 118(*k*) and 118(*j*), which may be deeper, such as 30 inches deep, between two pair of webs, 316 and 317 on one side and 318 and 319 on the other side. Similarly, shelves 118(*L*) are supported between a pair of webs 320 and 321 on one side, and 320 and 321 on the other side. In this situation, the single type bracket, such as bracket 201 or 222, would be used. Similarly, the longer type foot elements 301, such as illustrated in FIG. 48, would be used to from the base members.

As seen in FIGS. 52(*b*) and 53(*b*), any arrangement of shelves can be provided by the present invention. In one arrangements illustrated, the intermediate units have only two upper shelves leaving a larger lower space in the center. The versatility of arrangements, as provided by the present invention, is made possible by the structural interconnect-ability of the various elements forming the invention. As a result, an infinite variety of arrangements and beverage display units can be quickly and readily assembled by arranging the various elements and parts in a desired configuration.

While the present invention has been described and illustrated, with respect to certain preferred embodiments, which produce satisfactory results, it will be appreciated by those skilled in the art, after understanding the principals and concepts of the present invention, that various changes and modifications may be made without departing from the spirit and scope of the invention, and it is, therefore, intended to cover such changes and modifications in the appended claims.

What is claimed is:

1. A modular product display system comprising:

a base assembly;

at least two spaced apart upright supporting webs detachably connected to said base assembly;

a plurality of shelf assemblies positioned for support between said webs;

bracket means detachably connected to said webs for adjustably supporting said shelf assemblies between said webs, and means carried by said brackets for detachably engaging said shelf assemblies;

said webs including an arrangement of keyhole slots on at least one side thereof including a row of central keyhole slots having their axes aligned with each other and parallel to the longitudinal axis of said webs, and at least a first row of side keyhole slots having their axes parallel to each other and oriented at an angle of between 5° and 15° with respect to the longitudinal axis of said web; and said bracket means including a mounting plate, upper and lower connector elements carried by said mounting plate for coupling with said keyhole slots to support said bracket on said web, and at least one upwardly extending tab member for detachably engaging a support element of said shelf, said upper and lower connector elements being positionable in either said central or side keyhole slots for supporting said shelf assemblies in a horizontal or tilted condition.

2. A modular product display system according to claim 1 further comprising a second row of keyhole slots positioned on a side of said central keyhole slots opposite to said dirst row of side keyhole slots, said second row of keyhole slots having their axes parallel and aligned at an angle of between 5° and 15° with respect to the longitudinal axis of said web, said angle facing in a direction opposite to said angle of the axes of said first row of side keyhole slots so that said shelf assemblies may be positioned for tilting in either a forward or rearward direction.

3. A modular product display system according to claim 1 further comprising a platform carried by said supporting plate of said bracket means for supporting an edge of said shelf assemblies.

4. A modular product display system according to claim 1 wherein said connector elements are formed by pins extending from said mounting plate.

5. A modular product display system according to claim 4 wherein each of said pins comprises a shank portion and a head portion, said head portion having a diameter larger than the diameter of said shank portion to prevent undesired removal of said pins from said keyhole slots.

6. A modular product display system according to claim 3 wherein said upper and lower connector elements of said bracket means are each positioned on one side of said platform.

7. A modular product display system according to claim 3 wherein said lower connector element of said bracket means is positioned on one side of said platform and said upper connector element of said bracket means is positioned on the other side of said platform.

8. A modular product display system according to claim 1 wherein said bracket means carries two upwardly extending tabs for detachably engaging said shelf assemblies at two points along an edge thereof.

9. A modular product display system according to claim 1 wherein said base assembly comprises a foot member extending in a direction perpendicular to the longitudinal axis of said web, said foot member having means for securely supporting said web therein, and a kick plate having means carried at opposite ends thereof for detachably connecting said kick plate to an end of a foot member.

10. A modular product display system according to claim 9 wherein said means for detachably connecting said kick plates to said foot member comprises "L" shaped bent-over ends on said kick plates adapted to be slidably received in slot channels at the ends of said foot member.

11. A modular product display system according to claim 9 wherein said means for detachably connecting said kick plate to said foot member comprises hook fingers carried at the ends of said kick plates, and a plurality of slots positioned at the ends of said foot members for receiving said hook fingers.

12. A modular product display system according to claim 1 further including a header assembly comprising:

a web extension detachably connected to the upper ends of said webs opposite said base assembly;

a center beam having means at opposite longitudinal ends thereof for detachably connecting said beam to said web extension;

a pair of support beams having means at one end thereof for detachably connecting said support beams to said central beam;

a front display panel having means for detachably connecting said panels to said support beams;

a rear display panel detachably connected to said support beams; and side panels detachably connected to said support beams.

13. A modular product display system according to claim 12 wherein said base assembly comprises a foot member extending in a direction perpendicular to the longitudinal axis of said webs, means for securely supporting said web within said foot member, and a kick plate detachably connected between ends of said foot members.

14. A modular product display system according to claim 13 wherein said kick plates are of identical construction to said center beam of said header assembly.

15. A modular product display system according to claim 1 further comprising a bottom wedge shelf assembly including a bottom wedge member having a front end wider than a rear end, so that said bottom wedge member is tilted rearwardly, and a back wedge member detachably connected to the rear end of said bottom wedge member to provide rearward support for products carried on said bottom wedge member.

16. A modular product display system according to claim 15 further comprising a joiner element for detachably connecting said back wedge member to said bottom wedge member, said joiner element comprising a longitudinally extending member having an "L" shaped cross section, a plurality of hook fingers extending longitudinally therealong at the distal end of one leg of said "L" shaped cross section for engaging slotted openings in said bottom wedge member, and a lip portion carried at the distal end of the other leg thereof for engaging a slotted opening in said back wedge member.

17. A modular product display system according to claim 16 wherein said back wedge member is provided with a break-away notch for lowering the height of said back wedge member.

18. A modular product display system according to claim 1 wherein said webs comprise closed channed members formed of a pair of identical "C" shaped profiles, each profile having an extension element at one end thereof and a "C" shaped cross section at the other end thereof, said "C" shaped sections being crimped about said extension elements to form said channel members.

19. A modular product display system according to claim 18 wherein shoulders are formed on opposite sides of said extension elements when said "C" shaped sections are crimped thereabout.

20. A modular product display system according to claim 19 further comprising a web extension detachably connected to the upper ends of said webs opposite said base for supporting a header assembly, said web extension comprising a channel member arranged to fit telescopically within an upper end of said web, a plurality of holes provided in said channel member of said web extension for securing said web extension to said webs.

21. A modular product display system according to claim 20 further comprising a pair of channels provided on opposite sides of said web extension to provide guide means for telescopically fitting said web extensions with said webs.

22. A modular product display system according to claim 12 wherein said support beams are provided with a plurality of tab fingers at one end thereof, and wherein said web extensions are provided with a plurality of slots for receiving said tab fingers of said support beams for detachably connecting said support beams to said web extension.

23. A modular product display system according to claim 18 further comprising web covers carried on exposed sides of said webs for covering said keyhole slots.

24. A modular product display system according to claim 1 wherein said shelf assembly comprises a shelf unit comprising a grid-work of cross members, a top cover overlying said grid-work of cross member, a gravity feed top surface element overlying said top cover for supporting thereon products for display, and means to securely hold said top surface and said top cover to said grid-work of cross members.

25. A modular product display system according to claim 24 wherein said top surface element is made of a material having a low coefficient of friction and includes an array of raised elements on the top surface thereof to further minimize friction between said top surface element and said products for display.

26. A modular product display system according to claim 25 wherein products carried on said top surface element for display will automatically slide toward one end thereof when said shelf assembly is tilted toward said end.

27. A modular product display system according to claim 24 further comprising a pair of channel beams supported by said grid-work of cross members, said channel beams having slot means for receiving said upwardly extending tab member of said bracket means.

28. A modular product display system according to claim 25 further comprising a retainer plate carried by said grid-work and fastened to said channel beams for securing said channel beams to said grid-work.

29. A modular product display system according to claim 27 further comprising an arrangement of rails carried on said top surface element to form an enclosure for products being supported thereon.

30. A modular product display system according to claim 29 further comprising dividers extending between opposite rails carried by said top surface element.

31. A modular product display system according to claim 3 further comprising a plurality of ribs provided on said mounting plate to provide structural support and surfaces for engagement with said webs.

32. A modular product display system according to claim 3 wherein said platform has a width narrower than the length of said shelf assembly.

33. A modular product display system according to claim 3 wherein said platform has a width equal to the length of said shelf assembly.

34. A modular product display system according to claim 15 wherein said bottom wedge member has at least one longitudinally extending guide slot adjacent the forward end thereof for interlocking with said base assembly.

35. A modular product display system according to claim 34 further comprising at least one rear guide slot adjacent the rear end of said bottom wedge member for interlocking with said base.

36. A modular product display system according to claim 15 further comprising means for detachably interlocking said rear wedge member with said bottom wedge member comprising a plurality of keys carried by said rear wedge member, each key having a shank portion and an enlarged head portion, and a plurality of keyway slots positioned on said bottom wedge member for receiving said keys of said rear wedge member.

37. A modular product display system according to claim 36 further comprising a ratchet arrangement on the underside of said bottom wedge, said head portion of said keys being triangularly shaped so that a corner of said triangular head will engage one of the teeth of said ratchet arrangement to prevent movement of said back wedge member with respect to said bottom wedge member.

38. A modular product display system according to claim 16 further comprising a brace detachably connected between said back wedge member and said web for supporting said back wedge member on said bottom wedge member.

39. A modular product display system comprising a base assembly; at least two spaced apart upright supporting webs detachably connected to said base assembly; a plurality of shelf assemblies positioned for support between said webs; said shelf assemblies comprising a supporting grid-work, a top surface supported by said grid-work for carrying thereon products for display, a pair of channel beams carried by said supporting gridwork; bracket means detachably connected to said web for supporting said shelf assemblies between said webs, said bracket means comprising a mounting plate, upper and lower connecting elements carried by said mounting plate for coupling to said webs, and at least one upwardly extending tab member for detachably engaging said channel beams of said shelf assemblies; an arrangement of keyhole slots on at least one side of said webs including a row of central keyhole slots having their axes aligned with each other and parallel to the longitudinal axis of said webs, and at least a first row of side keyhole slots having their axes parallel to each other and oriented at an angle of between 5° and 15° with respect to the longitudinal axis of said web; said keyhole slots being arranged for receiving said connecting elements of said bracket means for supporting said shelf assemblies.

40. A modular product display system according to claim 39 wherein each of said upper and lower connecting elements comprises a pin having a shank portion and a head portion, said head portion having a diameter larger than the diameter of said shank portion to prevent undesired removal of said pin means from said keyhole slots.

41. A modular product display system according to claim 40 wherein said base assembly comprises a foot member for supporting each of said webs, and a kick plate connected between said foot members.

42. A modular product display system according to claim 41 wherein said foot member comprises a ductwork member formed between substantially identical interlocking halves, means for fastening said halves together, and means providing a guideway for receiving said webs.

43. A modular product display system according to claim 42 wherein said webs comprise closed channel members formed by identical "C" shaped profiles, each profile having an extension element at one end thereof and a "C" shaped cross section at the other end thereof, said "C" shaped sections being crimped about said extension elements to form said channel members, and shoulders being formed on opposite sides of said extension elements when said "C" shaped cross sections are crimped about said extension elements.

44. A modular product display system according to claim 43 wherein said means for fastening said halves together and for receiving said webs comprises inwardly extending and oppositely facing conically shaped recesses, and inwardly extending and oppositely facing indentations, whereby the space between said inwardly extending indentations and said conically shaped recesses froms a guideway for receiving said webs, and a nut and bolt arrangement extending between said halves so that as said nut and bolt arrangement are tightened, said conically shaped indentations will engage said shoulders of said webs to securely position said webs within said foot member.

* * * * *